US007527344B2

(12) United States Patent
Kitagawa et al.

(10) Patent No.: US 7,527,344 B2
(45) Date of Patent: May 5, 2009

(54) INK TANK HOLDER AND INK JET PRINTING HEAD CARTRIDGE

(75) Inventors: Takatoshi Kitagawa, Kawasaki (JP); Nobuyuki Hatasa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 240 days.

(21) Appl. No.: 11/455,854

(22) Filed: Jun. 20, 2006

(65) Prior Publication Data

US 2006/0290722 A1 Dec. 28, 2006

(30) Foreign Application Priority Data

Jun. 24, 2005 (JP) ..... 2005-185746

(51) Int. Cl.
*B41J 2/195* (2006.01)

(52) U.S. Cl. ..... 347/7

(58) Field of Classification Search ..... 347/7, 347/84–86

See application file for complete search history.

(56) References Cited

U.S. PATENT DOCUMENTS

| | | | | |
|---|---|---|---|---|
| 6,422,675 | B1 * | 7/2002 | Tomomatsu | 347/7 |
| 7,055,926 | B2 | 6/2006 | Kojima et al. | 347/19 |
| 2004/0109039 | A1 * | 6/2004 | Kojima et al. | 347/19 |
| 2005/0179750 | A1 | 8/2005 | Hayasaki et al. | 347/86 |
| 2006/0139422 | A1 | 6/2006 | Hatasa et al. | 347/86 |
| 2006/0244795 | A1 | 11/2006 | Hayasaki et al. | 347/86 |
| 2006/0290722 | A1 | 12/2006 | Kitagawa et al. | 347/7 |

FOREIGN PATENT DOCUMENTS

| | | | |
|---|---|---|---|
| JP | 4-275156 | | 9/1992 |
| JP | 05332812 | A * | 12/1993 |
| JP | 2001-253087 | | 9/2001 |
| JP | 2002-301829 | | 10/2002 |

OTHER PUBLICATIONS

Machine translation of detailed description of JP 05-332812 A.*
Machine translation of description of drawings of JP 05-332812 A.*
U.S. Appl. No. 11/665,547, filed Apr. 17, 2007 by Nobuyuki Hatasa and Takatoshi Kitagawa.

* cited by examiner

*Primary Examiner*—Matthew Luu
*Assistant Examiner*—Justin Seo
(74) *Attorney, Agent, or Firm*—Fitzpatrick, Cella, Harper & Scinto

(57) ABSTRACT

In a configuration to inform conditions of an ink tank such as an ink residual quantity by use of a light emitting portion such as a light emitting diode, a display in a position easily viewable to a user is achieved without requiring electric wiring that hinders user visibility and operability. A display section for displaying information by letting light out is separated from a light emitting portion, and a light guiding portion for achieving optical connection between both of the constituents is provided on an ink tank holder. In this way, it is possible to dispose the light emitting portion and the display section respectively in optimum locations, and to ensure freedom of disposing the display section in a position achieving fine user visibility.

11 Claims, 31 Drawing Sheets

INK TANK HOLDER AND INK JET PRINTING HEAD CARTRIDGE

BACKGROUND OF THE INVENTION

1. Field of the Invention

The present invention relates to an ink tank holder for detachably supporting an ink tank having a configuration to inform its own conditions such as an ink residual quantity used in ink jet printing by means of light emission of an indicator such as a light emitting diode (LED). The present invention also relates to an ink tank which is attachable to and detachable from the ink tank holder, and to an ink jet printing head cartridge provided with the ink tank holder.

2. Description of the Related Art

In recent years, print applications while connecting a digital camera directly to a printer as a printing apparatus without use of a personal computer (PC) are increasing along with spread of digital cameras. Moreover, print applications configured to perform data transfer by attaching a card-type information storage medium, which serves as an information storage medium detachable from a digital camera, directly to a printer are also increasing. While a method of checking an ink residual quantity inside an ink tank of a printer on a monitor of a PC is generally known, there is an increasing demand for grasping the ink residual quantity inside the ink tank without use of the PC in the case of printing without use of the PC. In other words, if a user is aware that the ink inside the ink tank is running out, the user is able to replace the ink tank with a new one before starting a printing operation, for example, and thereby to prevent substantive printing failures attributed to ink shortages in the course of printing operations.

In the prior art, a light emitting portion such as an LED has been known as means for informing a state of the ink tank to the user. In Japanese Patent Application Laid-open No. 4-275156 (1992), it is described that two LEDs are provided in an ink tank formed integral with a printing head, and are turned on, respectively, in correspondence to two stages of the remaining amount of ink. Similarly, in Japanese Patent Application Laid-open No. 2002-301829, a lamp is described, provided in an ink tank, capable of lighting in correspondence to the remaining amount of ink. Also, in this patent document, the above-mentioned lamp is provided in each of four ink tanks used in a printing apparatus.

On the other hand, in accordance with the recent requirement for the further improvement in image quality, light magenta or light cyan ink has been used in addition to the conventional four colors; i.e., black, yellow, magenta and cyan. Further, the use of a so-called particular color ink such as red or blue ink has been proposed. In such a case, the ink jet printer must be provided with 7 to 8 ink tanks. Thereupon, a mechanism is necessary for preventing the respective ink tank from being mounted to an erroneous position. In Japanese Patent Application Laid-open No. 2001-253087, a structure is disclosed wherein the mutual engagement shapes between mounting portions of a carriage and the respective ink tanks are different from each other. Thereby, it is possible to prevent the ink tank from being mounted to an erroneous position.

A location for disposing a light emitting portion such as an LED on the ink tank must be carefully determined in consideration of layouts of operating members for attaching the ink tank to a holder or a printing apparatus (printer) body and electrical contacts for transmitting electric signals for driving the light emitting portion. Therefore, the light emitting portion such as the LED, the operating members for fitting the ink tank, and the electrical contacts may restrict the layout freedom with one another. As a result, these members are not always disposed in the optimum locations.

For example, in the above-mentioned Japanese Patent Application Laid-open No. 4-275156 (1992), a structure of an ink cartridge is disclosed, wherein an LED is attached to a printed circuit board (PCB) for carrying out the electric communication with a printer body. According to such a structure, however, it is necessary to dispose the PCB to a position at which the LED is easily visible by the user. In addition thereto, it is necessary to provide an electric connecting part in the PCB for the electric communication with the printer body. Therefor, there is a problem in that the degree of arrangement freedom of each of the LED and the electric connecting part is restricted. While it is thought to provide a large-sized PCB for covering both preferable positions for the electric connecting part and the LED, the production cost rises therefor. When the structure disclosed in Japanese Patent Application Laid-open No. 4-275156 (1992) is applied to the printer capable of mounting a plurality of independent ink tanks for the respective colors, a structure for mounting the ink tanks onto the printer is limited. Accordingly, it is necessary either to minimize a substantial volume of the respective ink tank or to enlarge a size of the printer.

On the other hand, while there is the disclosure in Japanese Patent Application Laid-open No. 2002-301829 in that an ink alarming lamp for the ink tank is provided at a place easily visible by the user, a preferable structure for supplying a power or signals to the ink alarming lamp is not described. FIGS. 6 to 8 thereof suggest that the ink jet printing apparatus and the ink alarming lamp are connected to each other by conductor wires. However, the conductor wires in correspondence to the number of the ink alarming lamps are necessary, which complicates the wiring arrangement not only to cause the production cost to rise but also to deteriorate the visibility of the lamps by the conductor wires or the connection thereof. Also, in FIGS. 6 and 7 of Japanese Patent Application Laid-open No. 2002-301829, a structure is disclosed in which the ink alarming lamp is provided on an attaching lever which is a movable member operative for attaching the ink tank on the carriage. In this case, however, the arrangement of the conductor wires is further complicated to cause the production cost to rise and also the attachment/detachment of the ink tank becomes difficult.

These problems have been further significant because the position at which the display is carried out to be visible by the user is preferably limited to the location or in the vicinity of operating member for the attachment/detachment of the ink tanks, due to the minimization in size or the multifunctioning of the printer.

The display is not only visible by the user but also used for the control carried out by the printer body.

For example, as described above, a structure wherein lamps are provided in ink tanks is described in Japanese Patent Application Laid-open No. 2002-301829. Even in this case, however, when the control section of the printer body recognizes an ink tank in which an amount of ink remaining therein is insufficient, it is necessary to specify such an ink tank to be supplied with a signal for the purpose of lighting the lamp based on such the recognition. For example, when the ink tank has been mounted at an erroneous position, there might be a possibility in that another ink tank in which a sufficient amount of ink remains is displayed as no ink remains therein. Accordingly, when light-emitting control of the display such as a lamp is carried out, it is necessary as a prerequisite to identify the position of the ink tank to be mounted. To solve such problems, the light-emitting control of individual LED is carried out in each of a plurality of ink tanks, based on an output state of a light receiver section fixed in the printer, to identify the position at which the ink tank is mounted.

As described above, the LED on the ink tank may be required to have not only a function to emit light for informing the user of conditions but also a function to emit light toward a light receiver provided on the printing apparatus body for achieving desired control. From this point of view, it is undesirable to underutilize the light emitting functions due to the layout restriction of the LED.

SUMMARY OF THE INVENTION

The present invention has been made in view of the above-mentioned technical background, and an object thereof is to obtain the information of a state in an ink tank with a favorable visibility without deteriorating the user's operability, through a liquid container simple in structure as well as low in production cost.

In addition to providing the preferable visibility for the user, another object of the present invention is to provide the light emitting function properly for achieving the desired control.

In a first aspect of the present invention, there is provided an ink tank holder for detachably retaining an ink containing portion for containing ink to be used for an ink jet printing apparatus, a light emitting portion, and a contact to receive a signal for driving the light emitting portion from the ink jet printing apparatus, the ink tank holder comprising:

a light guiding portion for receiving light from the light emitting portion and guiding the light to project the light from a first light projecting section.

In a second aspect of the present invention, there is provided an ink jet printing head cartridge comprising:

an ink tank holder as described above; and a printing head for ejecting ink integrated with the ink tank holder.

According to the present invention, the display function is separated from the light emitting portion disposed on the ink tank and the light guiding portion is provided on the ink tank holder in order to establish optical connection between the light emitting portion and a display section. In this way, it is possible to achieve a configuration to dispose the light emitting portion and the display section respectively in the optimum locations at low costs without a requirement of wiring used for electric supply and signal transmitting, which may hinder visibility or operability. Moreover, by this configuration, it is possible to ensure the freedom of laying out the display section to an appropriate position to achieve fine user visibility, whereby a user can recognize certain information on the ink tank by visually checking a state of light emission of the display section easily. In addition, by appropriately laying out the display section and the light guiding portion, the light emitting function can be provided properly for the desired control of the printing apparatus.

The above and other objects, effects, features and advantages of the present invention will become more apparent from the following description of embodiments thereof taken in conjunction with the accompanying drawings.

BRIEF DESCRIPTION OF THE DRAWINGS

FIG. 21 is a circuit diagram showing details of the board provided with a control portion and the like;

FIG. 28A is a view showing a state of the control for attaching the ink tank where all the ink tanks are attached properly and respective LEDs are turned on, and FIG. 28B is a view for explaining a carriage moving to a position for an optical check when the body cover is closed after the LEDs are turned on;

DETAILED DESCRIPTION OF PREFERRED EMBODIMENTS

The present invention will be described below in more detail, with reference to the attached drawings illustrating the preferred embodiments.

1. Mechanical Structures

1.1 Embodiments of an Ink Tank and a Tank Holder (FIG. 1A to FIG. 6B)

Figure 1A:
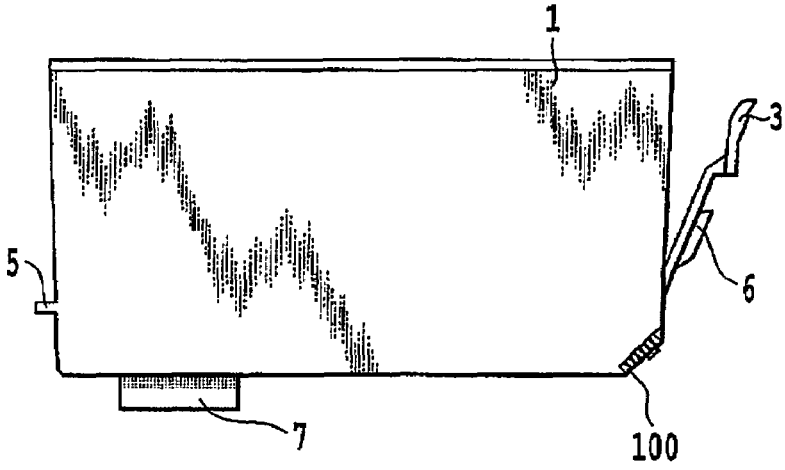
FIGS. 1A, 1B, and 1C are respectively a side view, a front view, and a bottom view of an ink tank according to a first embodiment of the present invention.
Figure 1B:
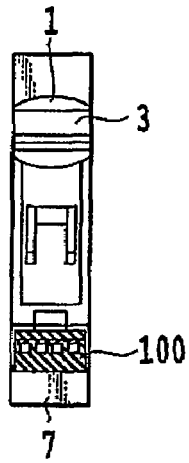
Figure 1C:
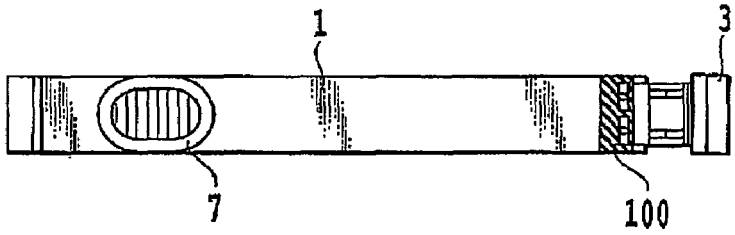

FIGS. 1A, 1B and 1C are a side view, a front view and a bottom view, respectively, of an ink tank which is a liquid container according to a first embodiment of the present invention. In this regard, in the following description, a front surface of the ink tank is a surface opposed to the user, from which the manipulation of the ink tank such as an attachment/detachment thereof and the transmission of information to the user (the projecting of light from a display section described later) are possible.

In FIGS. 1A to 1C, the ink tank 1 according to this embodiment has a supporting member 3 supported in a lower portion of the front surface. The supporting member 3 is formed of resin to be integral with an outer casing of the ink tank 1 so that it is movable about a supported portion, for example, when mounted to a tank holder described later. A first engagement section 5 and a second engagement section 6 (integral with the supporting member 3 in this embodiment) are provided on the rear and front sides, respectively, of the ink tank 1 so that the ink tank 1 is secured to the tank holder by the engagement thereof. The operation during the mounting will be described later with reference to FIGS. 15A to 15C.

On a bottom surface of the ink tank 1, an ink supply port 7 is provided to be coupled to an ink introduction port of a printing head described later when the ink tank is mounted to the ink tank holder. A substrate body is provided on the bottom surface side of a supporting part of the supporting member 3 at an intersection between the bottom and front surfaces. Although the substrate body may be of a chip shape or a plate shape, the following description will be made as a board 100.

The interior of the ink tank 1 is divided into an ink storage chamber 11 disposed on the front side on which the supporting member 3 and the board 100 are provided and a negative pressure generating member storage chamber disposed on the rear side to communicate with the ink supply port 7, wherein both the chambers are connected to each other via communication port 13. While ink I is directly stored in the ink storage chamber 11, a porous member impregnated with ink such as sponge or the like is accommodated in the negative pressure generating member storage chamber. The porous member 15 generates a proper negative pressure in a range sufficient for preventing ink from leaking from an ink ejection orifice while being equilibrated with a force for holding a meniscus formed in an ink ejection nozzle of the printing head, as well as for allowing the ink ejection from the printing head. The porous member 15 may be a capillary force generating member made of fabric. On an upper face of the negative pressure generating material chamber 12, formed is an air communicating portion (not shown) configured to introduce outside air for relaxing the negative pressure increased with the ink supply to the printing head and thereby maintaining the negative pressure in a predetermined desirable range.

In this regard, the interior structure of the ink tank is not limited to the above-mentioned one divided into the porous member storage chamber and the ink storage chamber. For example, substantially all the interior space of the ink tank may be filled with the porous member. Also, instead of using the porous member as means for generating negative pressure, a bag member made of elastic material such as rubber to generate a tension in the direction for increasing the volume may be filled with ink so that the negative pressure is applied to the ink therein due to the tension generated from the bag member. Further, at least part of the ink storage space may be formed of a flexible member, and this space is filled solely with ink. Under such conditions, a spring force is applied to the flexible member to generate a negative pressure.

A detection target 17 is formed at a bottom of the ink chamber 11 in an appropriate region so that the detection target can face an ink residual quantity detection sensor (to be described later) provided on the printer when attaching the ink tank 1 to the printer. In this embodiment, the ink residual quantity detection sensor is an optical sensor utilizing a light emitting portion and a light receiving portion. Meanwhile, the detection target 17 is made of a transparent or translucent material whose refractive index substantially equals to that of contained ink and is formed into a prism shape having inclined faces with predetermined shape, angle, and the like so as to reflect light from the light emitting portion back to the light receiving portion (to be described later) appropriately when the ink is not contained.

Figure 3:
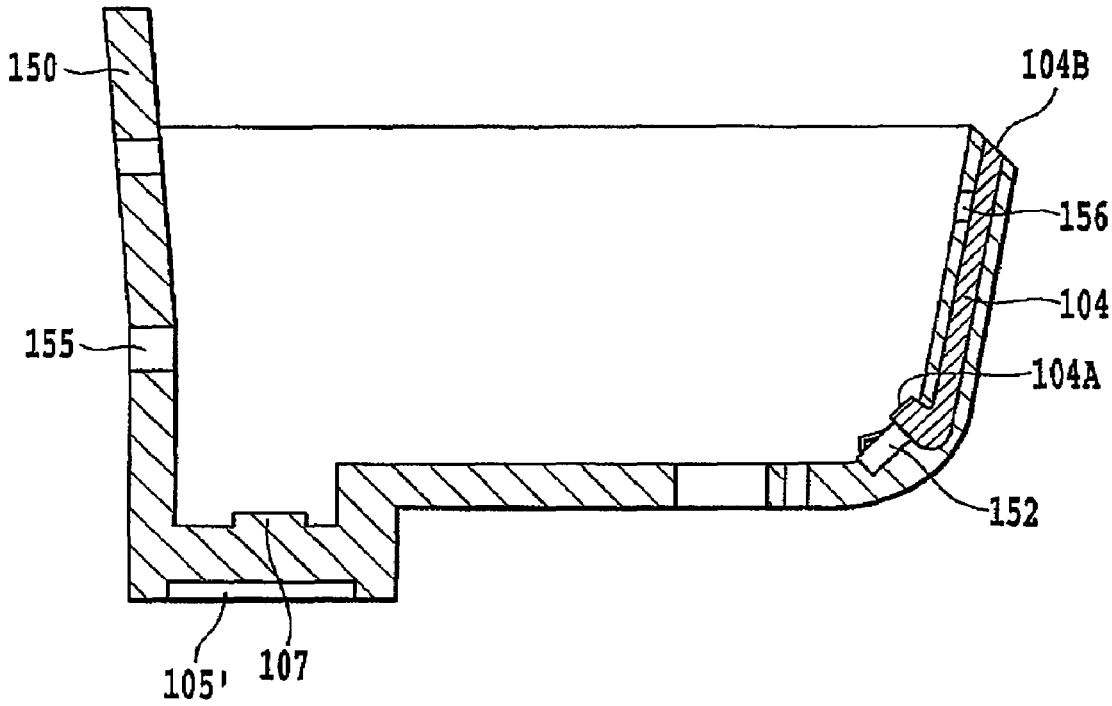
FIG. 3 is a schematic sectional side view showing an ink holder according to the first embodiment of the present invention, configured to detachably hold the ink tank shown in FIG. 2.
Figure 4A:
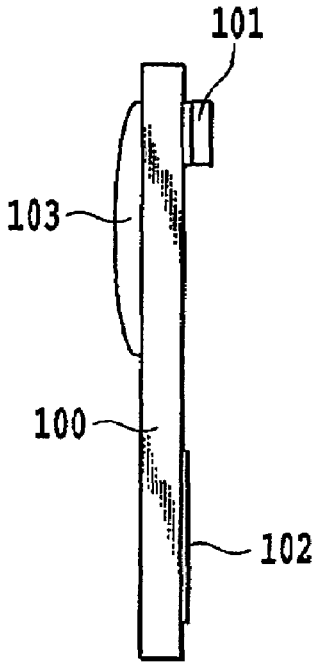
FIGS. 4A and 4B are respectively a side view and a front view showing an example of a control board to be attached to the ink tank shown in FIG. 2.
Figure 4B:
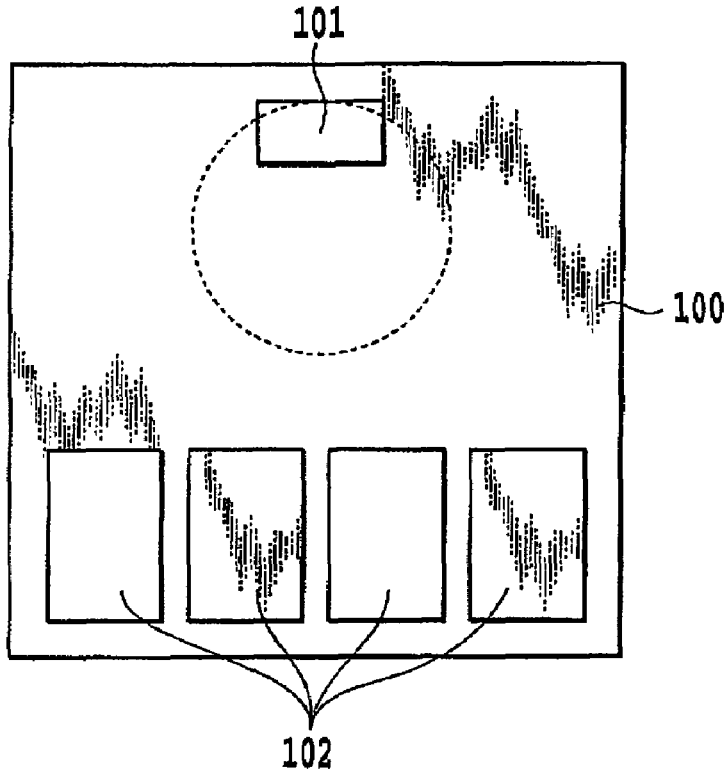
Figure 5A:
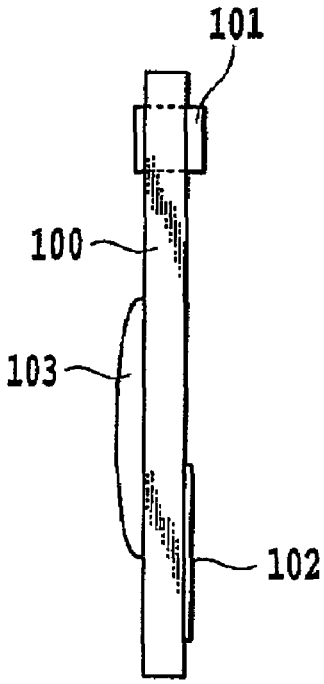
FIGS. 5A and 5B are respectively a side view and a front view showing a modified example of the control board to be attached to the ink tank shown in FIG. 2.
Figure 5B:
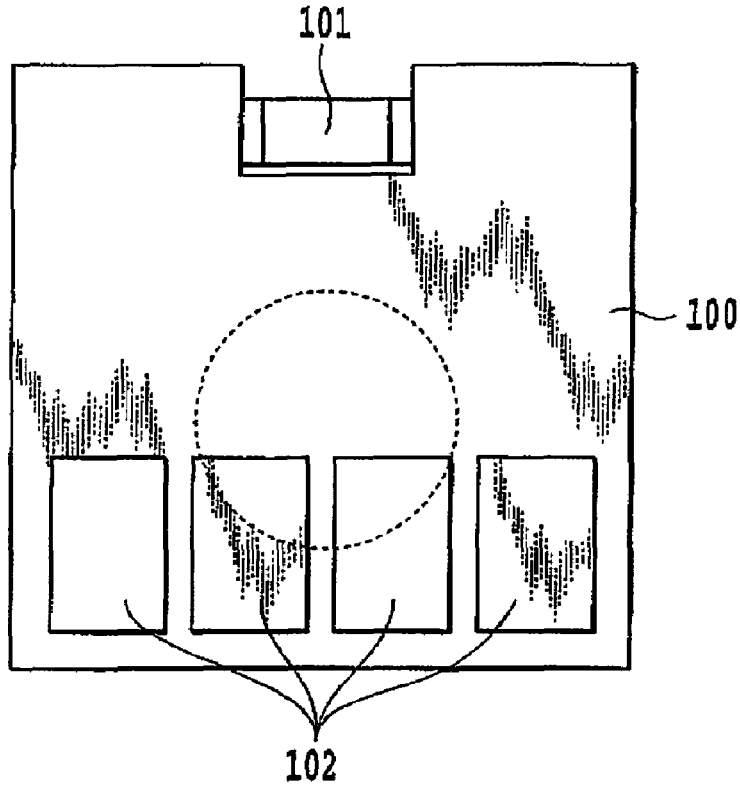
Figure 6A:
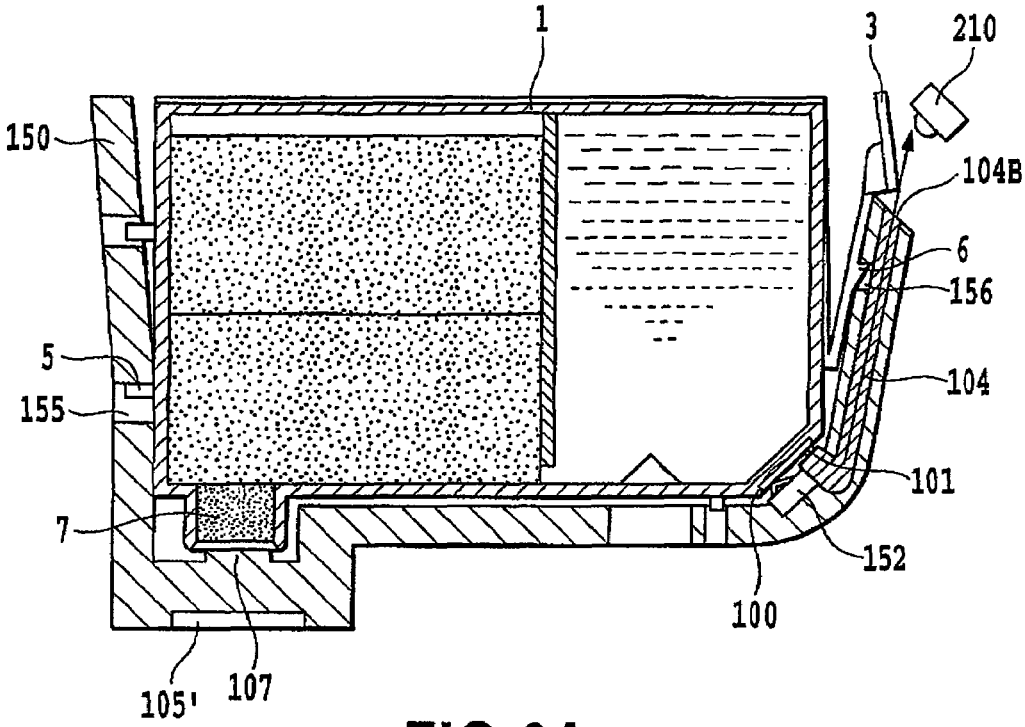
FIGS. 6A and 6B are schematic sectional side views explaining outlines of functions of the ink tank and the ink tank holder according to the first embodiment.
Figure 6B:
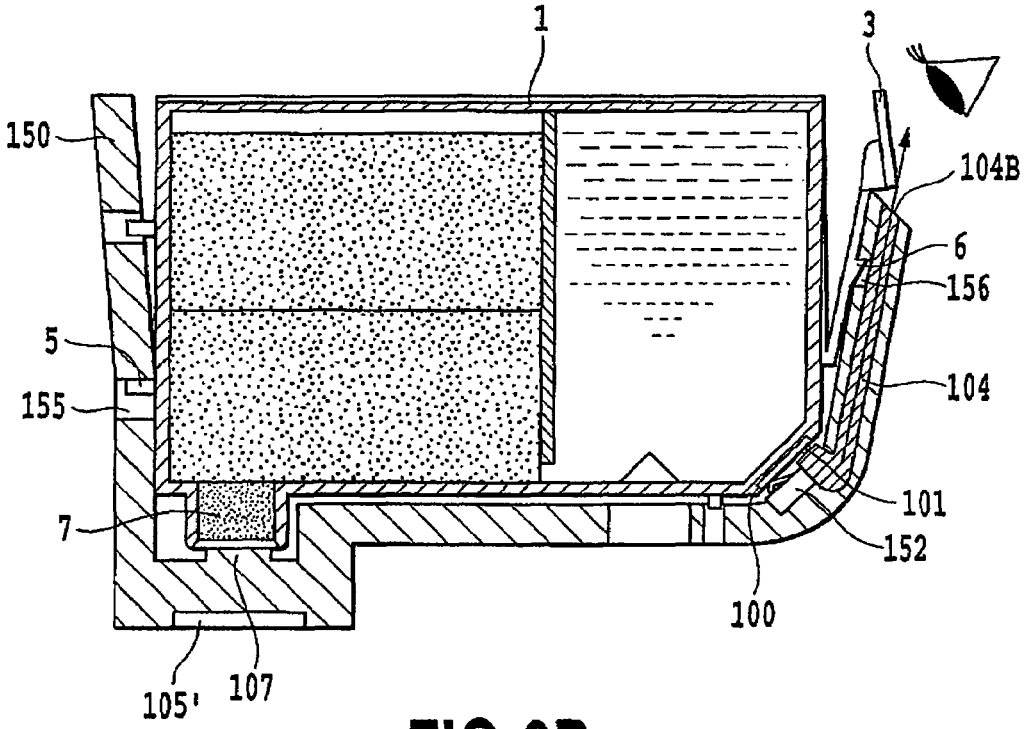

A configuration and functions of principal parts in the present embodiment will be described with reference to FIG. 3 to FIG. 6B. Here, FIG. 3 is a schematic sectional side view showing an ink tank holder according to an embodiment of the present invention configured to detachably hold the ink tank shown in FIG. 1. FIGS. 4A and 4B are respectively a side view and a front view showing an example of a control board to be attached to the ink tank according to the first embodiment. FIGS. 5A and 5B are respectively a side view and a front view showing another example of the control board. FIGS. 6A and 6B are schematic sectional side views explaining outlines of functions of the ink tank and the ink tank holder.

In this embodiment, an ink tank holder ((hereinafter referred to as a tank holder or a holder) 150 is formed integral with a printing head unit 105 provided with a printing head 105'. The first and second engagement sections 5 and 6 of the ink tank 1 are engaged with first and second fitting sections 155 and 156, respectively, of the holder 150. Thereby, the ink tank 1 is mounted on the holder 150 and fixed thereto. At this time, a connector 152 provided on the holder 150 is brought into an electrode pad 102 (see FIG. 4B) provided on a surface of the board 100 in the ink tank opposed to outside to make the electric connection. Further, in this embodiment, a light incident end 104A provided on a light guiding portion 104 is disposed on a light axis of the light emitting portion 101 provided on the board 100. In this way, when the light emitting portion 101 emits light, the light is received and guided by the light guiding portion, and by projecting the light from another end 104B of the the light guiding portion, it is possible to display for the user and the printer side light-receiving portion as described later.

Here, the light guiding portion 104 may be made of any kind of light-transmissive or light-guiding materials. For example, it is possible to form the light guiding portion 104 by use of polypropylene or polycarbonate. Meanwhile, it is also possible to add means for suppressing light transmission from a side surface of the light guiding portion to the outside and thereby achieving efficient light guiding. Additionally, it is also possible to widen a visually observable angle (range) to a user by forming the end 104B of the light guiding portion 104 into a substantially semispherical shape or by roughening a surface of the end 104B to cause favorable light scattering and thereby diffusing projecting light from the end 104B. In addition, as for the light guiding portion, it is possible to apply an optical fiber composed of a core and a clad instead of forming the light guiding portion with resin, and to adopt a hollow member (such as a stainless steel pipe) having a light reflective inner side surface instead of using a solid member.

As shown in FIGS. 4A and 4B, a control portion 103 for controlling light emission by an LED is provided on a surface of the board 100 facing the inside of the ink tank 1. A light emitting portion 101 such as an LED for irradiating light onto an incident position of the light guiding portion 104 of the ink tank holder 150 is disposed on the surface on which the pad 102 is mounted The control portion 103 controls light emission by the first light emitting portion 101 by use of an electric signal to be supplied from the connector 152 via the pad 102. Here, FIGS. 4A and 4B show a state where the control portion 103 is mounted on the board 100 and then covered with a sealing agent for protection. When embedding a memory element for storing information such as a color of the ink contained in the ink tank or fine residual quantity of the ink, it is also possible to mount the memory element in the same position and to cover the memory element with a sealing agent.

Note that the layout position of the light emitting portion 101 is not limited to the examples shown in FIG. 4A and 4B. It is possible to provide the light emitting portion 101 to any appropriate regions as long as irradiation of light onto an incident position of the light guiding portion 104 is possible with the ink tank 1 being attached to the holder 150. For example, as shown in FIGS. 5A and 5B, it is possible to provide a notch on one edge of the board 100 so as to hold the light emitting portion 101 inside the notch. This layout prevents significant protrusion of the light emitting portion 101 from the board 100. Accordingly, it is possible to reduce a risk that the light emitting portion 101 obstructs other members when attaching or detaching the ink tank.

As described previously, the board 100 is placed below the supporting part of the supporting member 3 at the junction of the two surfaces respectively constituting the bottom surface and the front surface of the ink tank 1. In this layout position, a bevel is formed on the ink tank 1 so as to join the two surfaces. Accordingly, when the ink tank 1 is properly attached to the ink tank holder 150 (FIGS. 6A and 6B), light emitted from the light emitting portion 101 is projected outward, and is received and guided by the light guiding portion 104 formed on the tank holder 150. In this way, it is possible to present certain information on the ink tank 1 directly to the printing apparatus (and eventually to a host device such as a computer connected to the printing apparatus) and to a user with the end 104B of the light guiding portion 104 being used as a display section irrespective of the layout position of the light emitting portion 101.

As shown in FIG. 6A, a light receiving portion 210 is disposed at an end of a scanning range of a carriage mounting the ink tank holder 150 and on an extension of an axis of the light projected from the end 104B of the light guiding portion 104. Then, the light emitting portion 101 is controlled to emit light when the carriage is located in a position corresponding to that layout position of the light receiving portion, whereby the printing apparatus can recognize the certain information on the ink tank 1 by use of the content of the light received by the light receiving portion. Moreover, the light emitting portion 101 is controlled to emit light when the carriage is located at the center of the scanning range, for example, whereby the user can recognize the certain information on the ink tank 1 by viewing the projecting light from the end 104B of the light guiding portion 104 as shown in FIG. 6B.

In such a manner, according to this embodiment, the light emitting section is separated from the display section, and the light guiding portion 104 is provided in the ink tank holder 150, for optically connecting the both with each other. Thereby, it is possible to obtain a structure for arranging the light emitting section and the display section at the best positions, respectively, at a low cost without needing the wiring for the power supply and the signal transmission which may disturb the visibility and the operability of the user. Further, it is possible to secure the degree of freedom for the arrangement of the display section at a favorable position ensuring the visibility for the user and the light receivability for the printer.

The desired information on the ink tank 1 for instance includes the following information, namely, appropriateness of the attachment condition of the ink tank 1 (i.e. as to whether or not the ink tank 1 is perfectly attached), appropriateness of the attached position (as to whether or not the ink tank is properly attached to a predetermined position on the holder in terms of the color of the ink contained therein), the ink residual quantity (as to whether there is a sufficient amount of the ink or not), and the like. The foregoing information can be indicated by way of light emission and the state of the light emission (such as blinking). The light emission control and relevant aspects of indicating the information will be described later along with explanation for a configuration of a control system.

1.2 Other Embodiments of the Ink Tank and the Tank Holder (FIG. 7A to FIG. 13)

The above described configuration is merely an example. Various appropriate modifications are possible as long as the certain information on the ink tank 1 can be presented to the printing apparatus and the user by use of the light guiding portion. In this section, some other embodiments will be described.

For example, it is desirable, by appropriately designing the layout position and the shape of the supporting member 3, to avoid an interception of the optical axis. This is targeted for allowing the light emitted from the light emitting portion 101 to be favorably received by the light guiding portion 104 and for allowing the projecting light from the end 104B of the light guiding portion 104 to reach the light receiving portion 210 and the sight of the user smoothly. Nevertheless, it is also possible to make positive use of the supporting member 3.

Figure 7A:
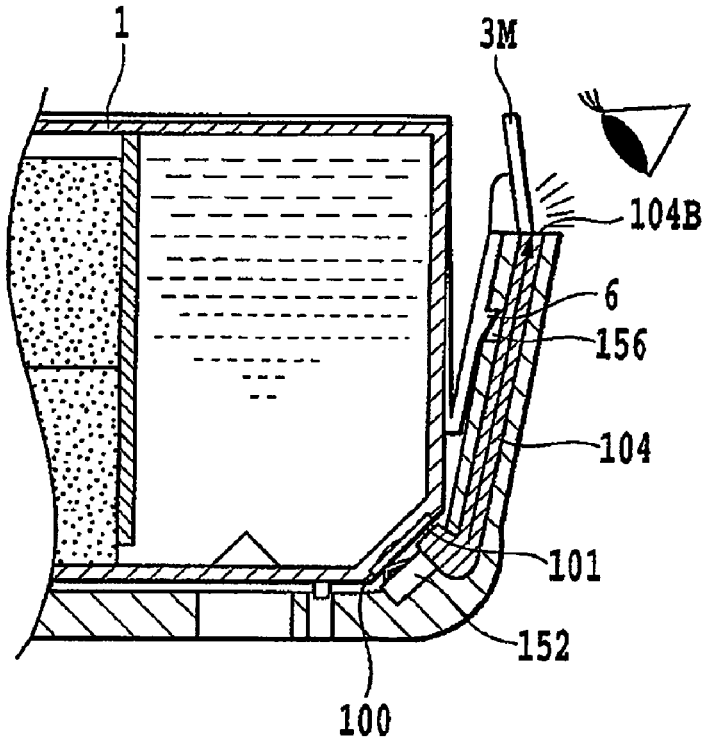
FIGS. 7A and 7B are schematic sectional side views showing two modified examples of the ink tank and the ink tank holder according to the first embodiment.
Figure 7B:
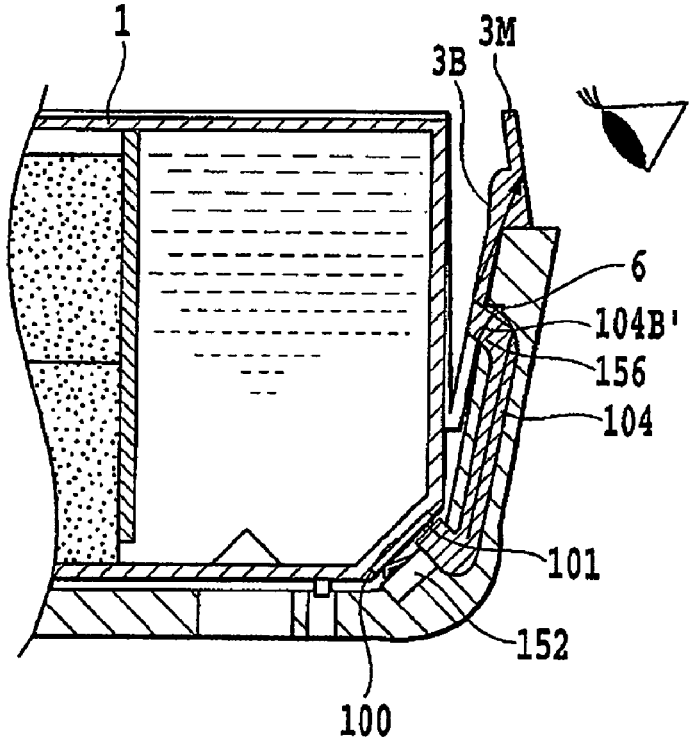

FIGS. 7A and 7B are schematic sectional side views showing two examples of the ink tank and the ink tank holder. First, FIG. 7A shows an example of allowing at least part of the light emitted from the end 104B as a first light projecting section of the light guiding portion 104 to be guided to an operating portion 3M of the supporting member 3, which is operated by the user in particular, and then to be emitted therefrom. In this way, the light is directed to the user (or the light receiving portion 210). Meanwhile, FIG. 7B shows an example of forming a light guiding portion 3B, which has an end either facing or abutting on an end 104B' as the first light projecting section of the light guiding portion 104 when the ink tank is mounted, on the supporting member 3 of the ink tank, and of integrating the light guiding portion 3B with the operating portion 3M. In this way, the light is emitted from the operating portion 3M. That is, in any of these cases, the operating portion 3M is provided with a light projecting section that functions as a display section for a visual check by the user (or light reception by the light receiving portion 210).

Here, in these cases, the operating portion 3M and the light guiding portion 3B are made of a light transmissive material. Moreover, it is possible to adopt a configuration to diffuse the light favorably on a light projecting surface of the operating portion. Further, in the case of FIG. 7A in particular, it is possible to achieve display by illuminating the operating portion 3M by projecting the light from the end of the light guiding portion 104, instead of guiding the light from the end 104B of the light guiding portion 104 directly to the operating portion 3M.

In any case, a similar effect to the one in the above-described embodiment is achieved. Moreover, the operating portion 3M, which is the section to be operated by the user, emits the light in these examples. For this reason, in the case of encouraging the user to replace the ink tank, it is possible to allow the user to recognize the ink tank subject to replacement intuitively and to recognize a position for attaching and detaching the ink tank (the operating portion) intuitively as well.

In the above-described configurations, the board 100 is located on the bevel of the supporting member 3 at the junction of the two surfaces respectively constituting the bottom surface and the front surface of the ink tank 1. However, the layout position of the board 100 can be determined appropriately, and the shape of the light guiding portion can be also determined appropriately in accordance therewith.

Figure 8:
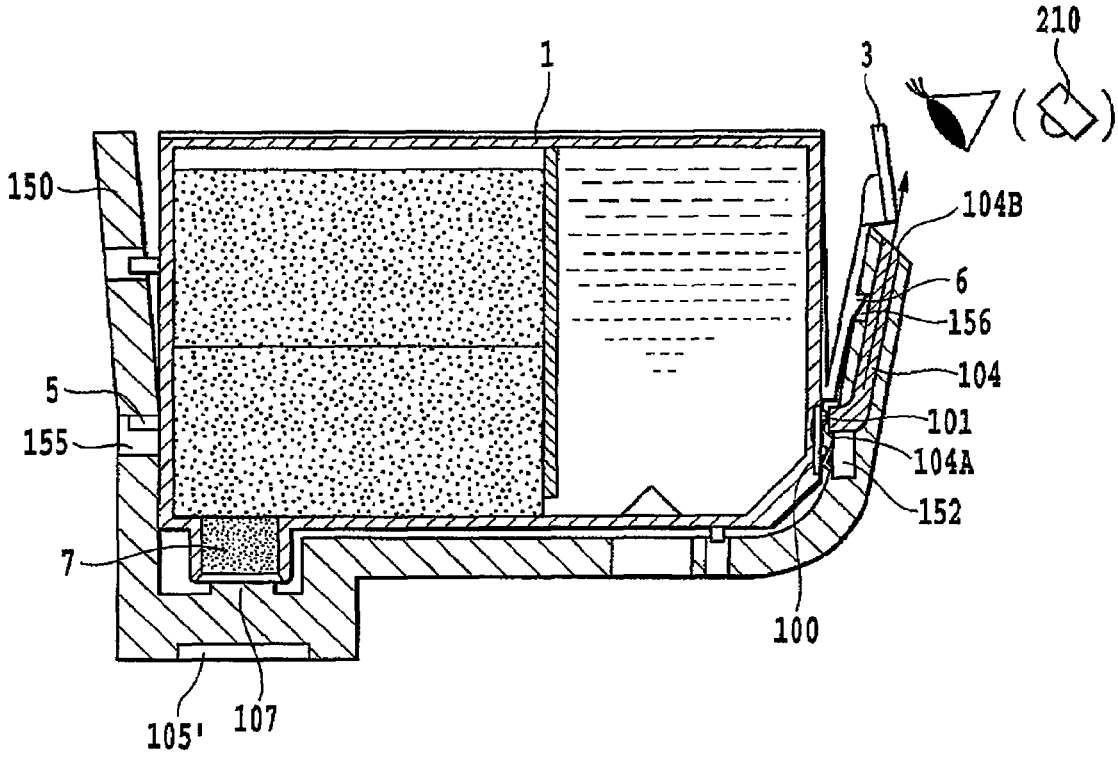
FIG. 8 is a schematic sectional side view showing an ink tank and an ink tank holder according to another embodiment.
Figure 9:
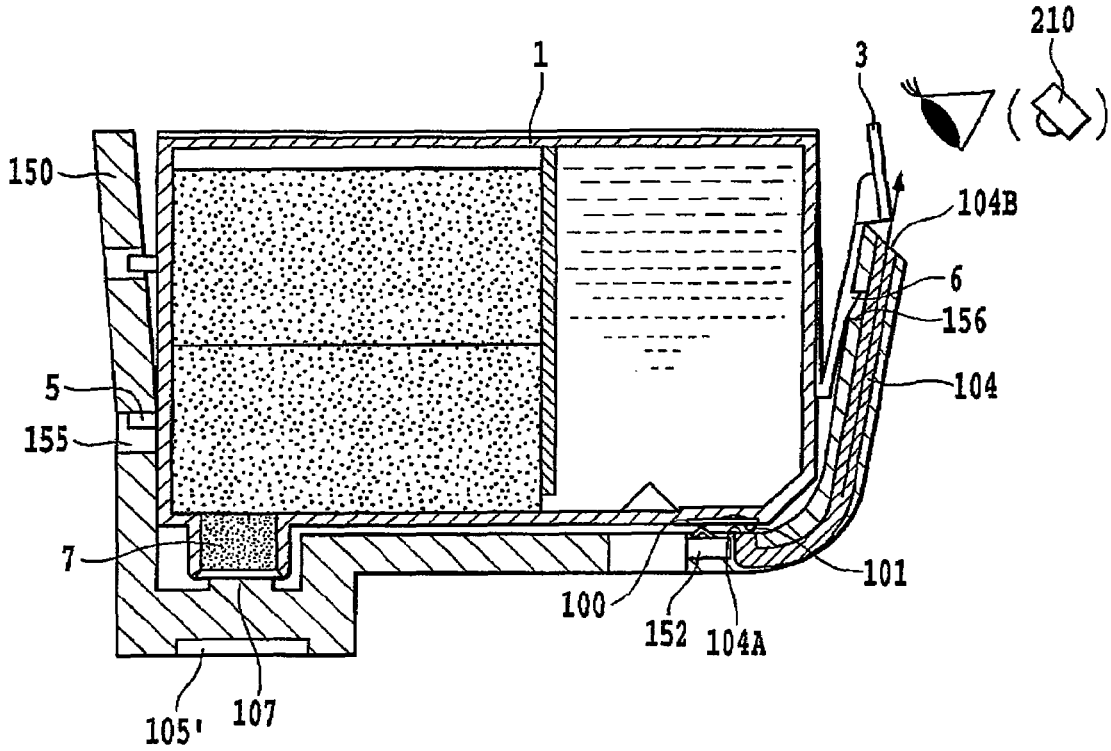
FIG. 9 is a schematic sectional side view showing an ink tank and an ink tank holder according to still another embodiment.

FIG. 8 and FIG. 9 are sectional side views describing two examples of the ink tank and the ink tank holder in such cases. First, the example shown in FIG. 8 is configured to locate the control board 100 in a position on the front surface of the ink tank below the supporting member 3. Meanwhile, the example shown in FIG. 9 is configured to locate the control board 100 in a position on the bottom surface of the ink tank 1. In any of these case as well, the shape of the light guiding portion 104 is designed appropriately so as to allow the light incident end 104A of the light guiding portion 104 to face the light emitting portion 101 when the ink tank 1 is mounted on the holder 150. In this way, it is possible to use the end 104B of the light guiding portion 104 as the display section for a visual check by the user (or light reception by the light receiving portion 210).

Further, it is also possible to guide the light to two or more light projecting sections by appropriately branching the light guiding portion of the ink holder 150 so as to achieve multiple control operations.

Figure 10:
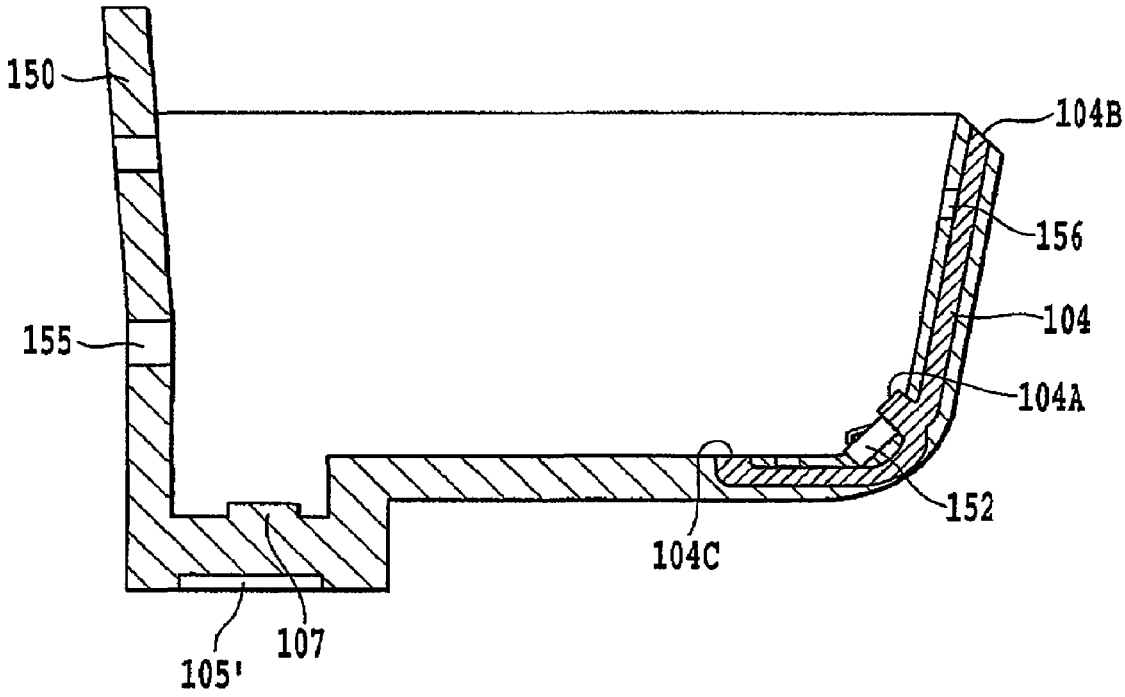
FIG. 10 is a schematic sectional side view showing a first example of the ink tank holder according to another embodiment of the present invention.
Figure 11:
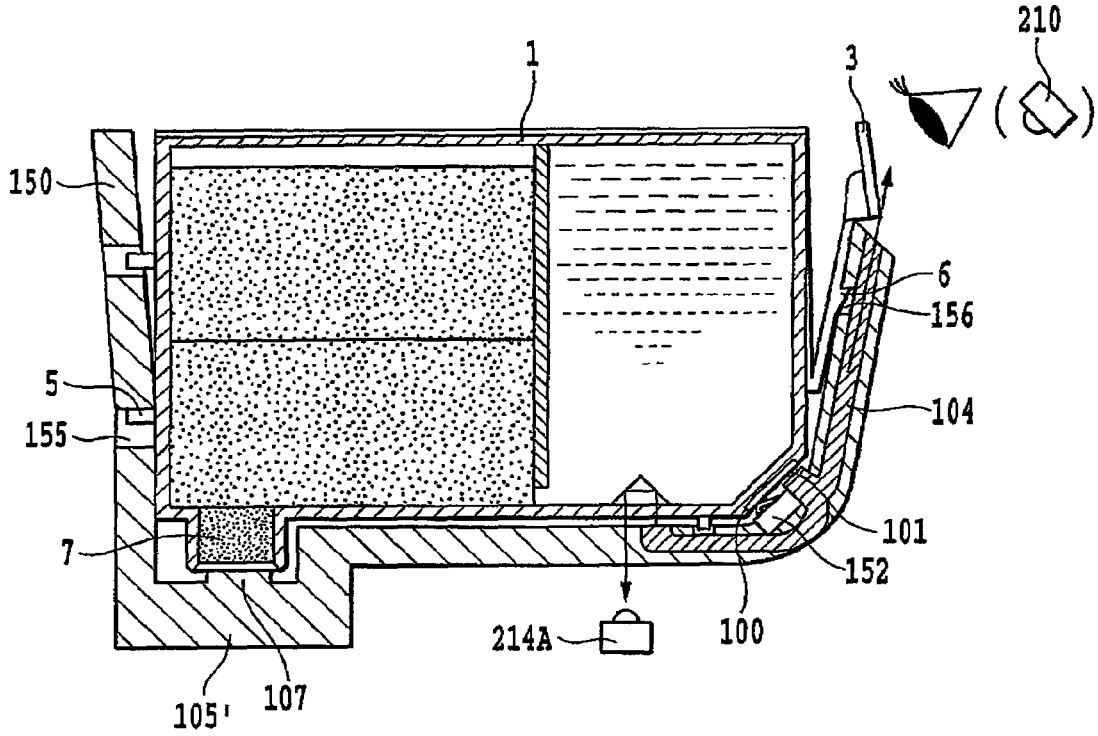
FIG. 11 is a schematic sectional side view explaining an outline of functions of the ink tank holder of the embodiment shown in FIG. 10.

FIG. 10 is a schematic sectional side view showing an ink holder describing such an example, and FIG. 11 is a schematic sectional side view for explaining functions of the ink tank and the ink tank holder of the present embodiment.

In the illustrated example, the light guiding portion 104 includes a portion for guiding the light received from the light emitting portion 101 to the end portion 104B as the first light projecting section facing the user or the light receiving portion 210 when the ink tank is mounted. In addition, the light guiding portion 104 includes a branch as a portion for guiding the light to an end 104C a second light projecting section facing one of the oblique surfaces of the prism-shaped detection target 17 that is provided on the ink tank 1 by branching the optical guiding route. That is, this example is configured to allow the light emitting portion 101 of the ink tank 1 to function as a light emitting portion of the ink residual quantity detection sensor as well.

As described previously, the ink residual quantity sensor is the optical sensor that applies the light emitting portion and the light receiving portion. Meanwhile, the detection target 17 is made of a transparent or translucent material having a refractive index substantially equal to that of the contained ink. Moreover, the detection target 17 is formed into the prism shape having the two oblique surfaces of the predetermined shapes, angles, and the like so as to reflect the light from the light emitting portion appropriately back to the light receiving portion when the ink is not contained therein. In this example, one of the oblique surfaces is opposed to the end 104C of the light guiding portion 104. Accordingly, it is possible to use the light emitting portion 101 also as the light emitting portion of the ink residual quantity detection sensor. In this way, the printing apparatus only needs to have a light receiving portion 214A opposed to the other oblique surface.

Figure 12A:
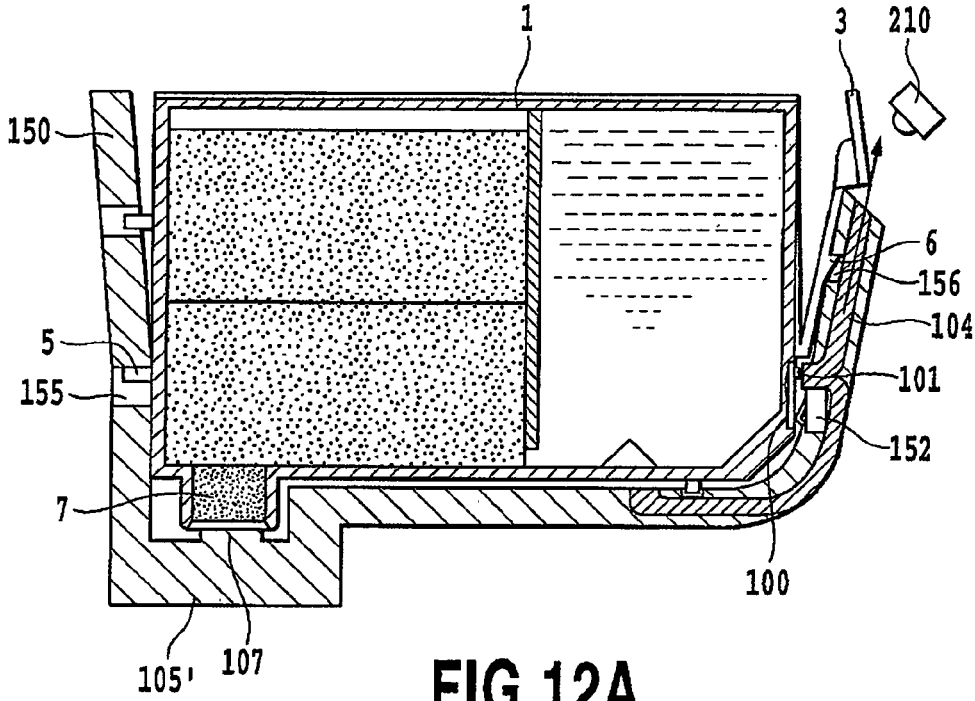
FIGS. 12A and 12B are schematic sectional side views showing an embodiment applying the basic configuration in FIG. 10 to the configuration in FIG. 8.
Figure 12B:
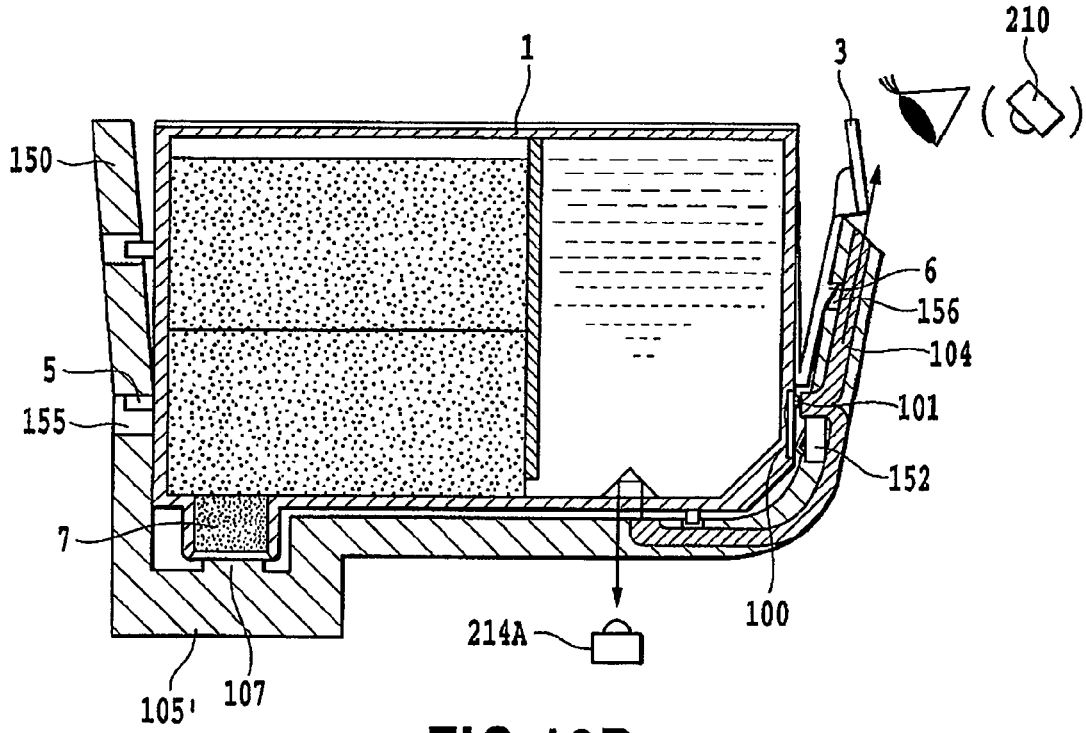
Figure 13:
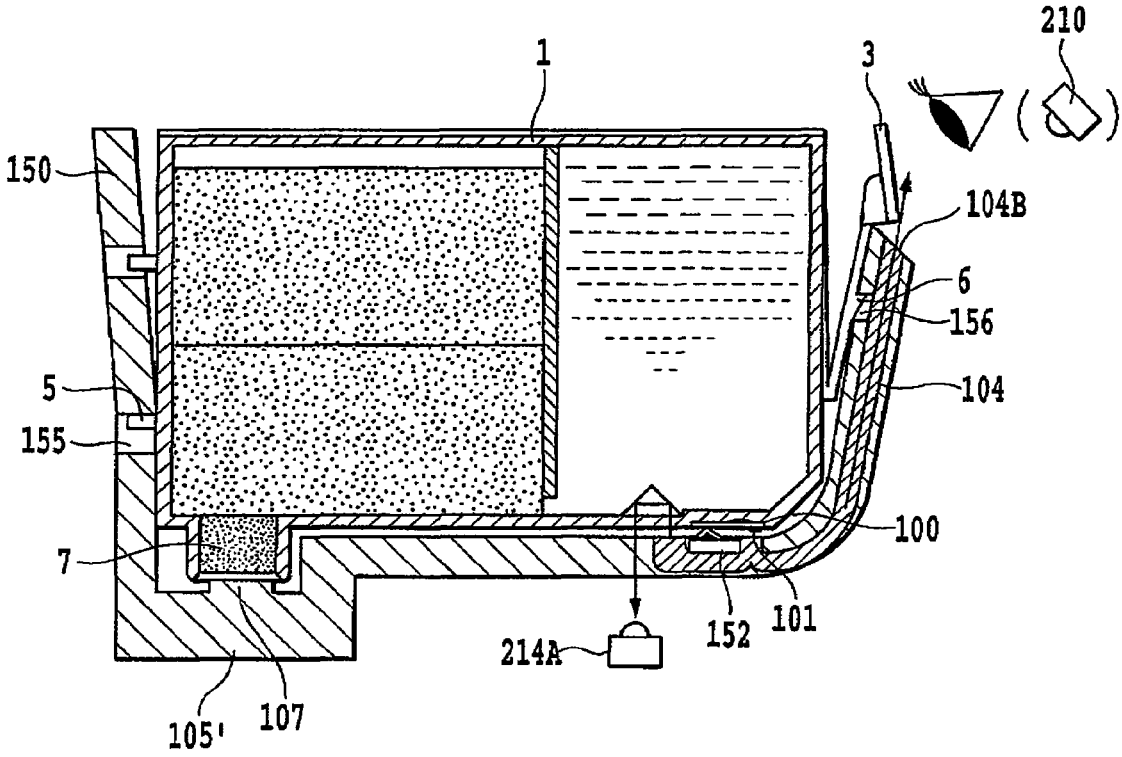
FIG. 13 is a schematic sectional side view showing an embodiment applying the basic configuration in FIG. 10 to the configuration in FIG. 9.

It is needless to say that the configuration of the light guiding portion in this example is also applicable to the configurations shown in FIG. 8 and FIG. 9. FIGS. 12A, 12B and FIG. 13A illustrate such application examples. Here, FIGS. 12A and 12B shows a case of applying the configuration of this example when the control board 100 is located in the position on the front surface of the ink tank below the supporting member 3, while FIG. 13 shows a case of applying the configuration of this example when the control board 100 is located in the position on the bottom surface of the ink tank 1.

Figure 2:
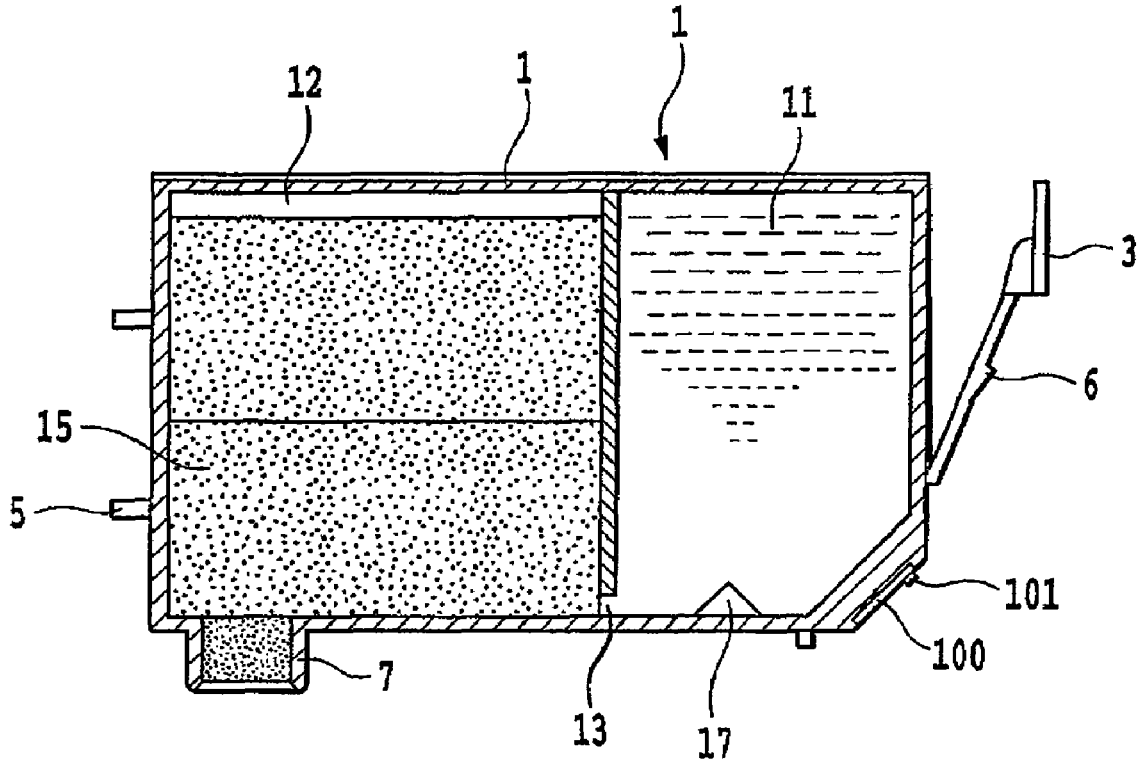
FIG. 2 is a sectional side view of the ink tank according to the first embodiment.

Moreover, for example, a third light projecting section different from the first and second light projecting sections may be provided at a location opposed to a casing portion such as the negative pressure generating material chamber 12 of the ink tank 1 shown in FIG. 2, for projecting light toward the ink tank 1. If the ink tank 1 has an indication such as bar-code on the casing, it is possible to read information from the indication such as bar-code by utilizing the light from the third light projecting section. As just described, a number of the light projecting sections or branches can be determined as appropriate. Furthermore, by providing multiple branches with the light guiding portion in the ink tank holder, it is possible to brighten the whole tank holder on which an ink tank is to be attached. When replacing an ink tank of a certain color with a new one, by brightening a holder portion on which the corresponding ink tank of the color is attached, the user can visually recognize a position for detaching and attaching the ink tank.

1.3 Ink Tank Fixture (FIGS. 14 to 16B)

Figure 14:
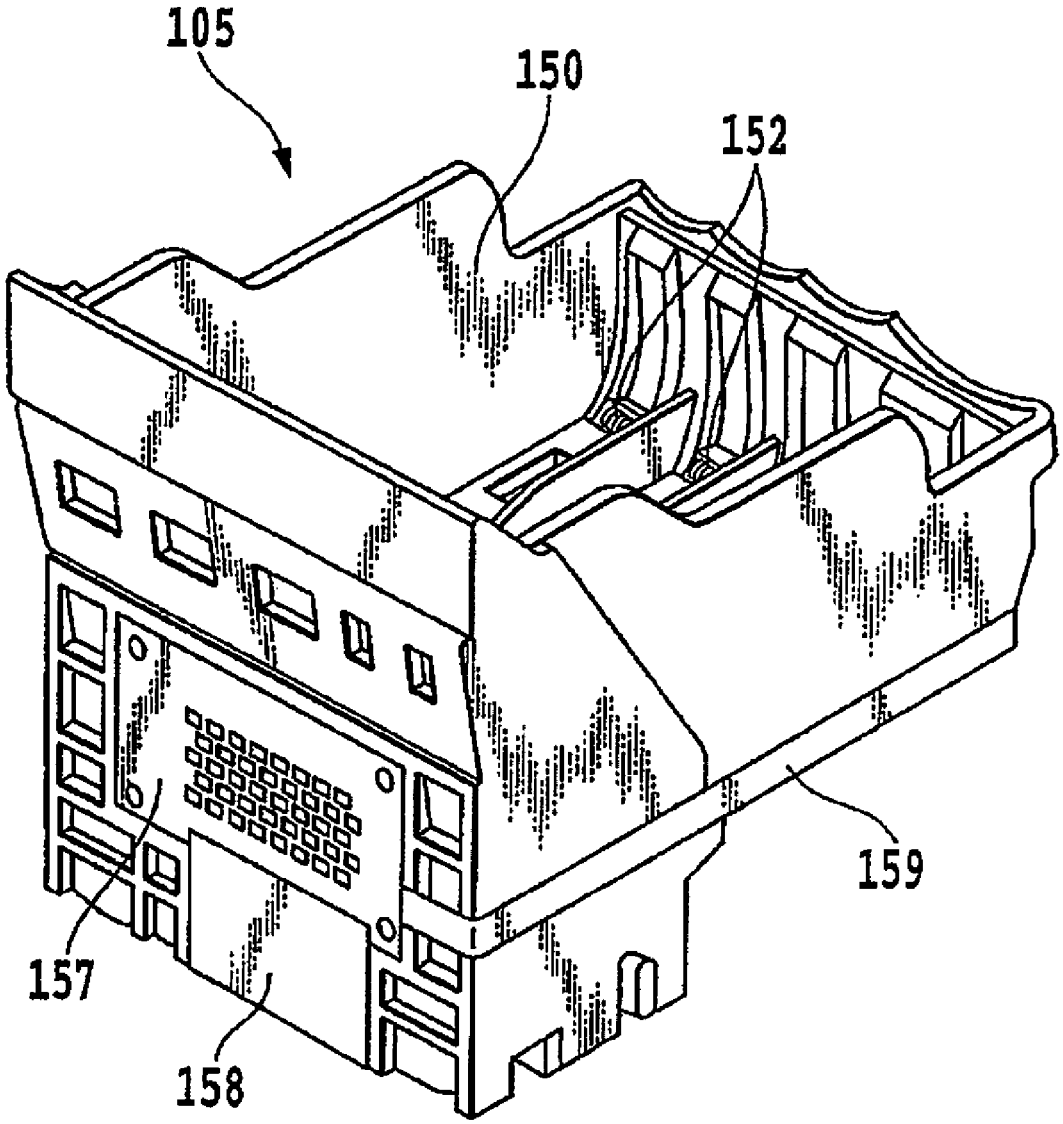
FIG. 14 is a perspective view showing an example of a printing head unit including a holder which allows attachment of the ink tanks according to the first embodiment.
Figure 15B:
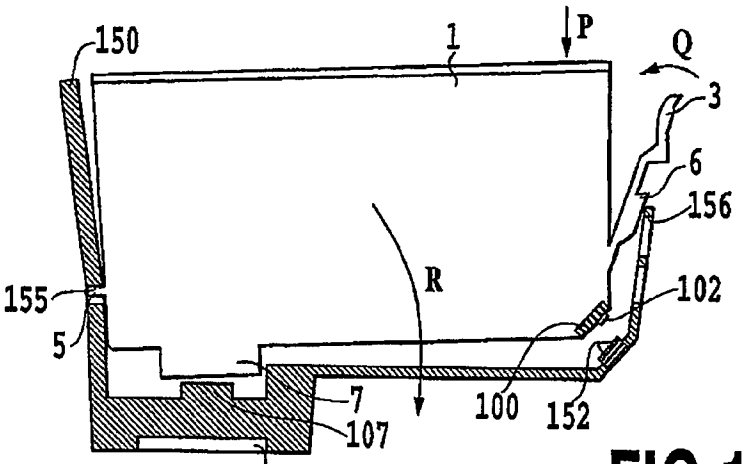
FIGS. 15A, 15B, and 15C are schematic side views for explaining an operation to attach the ink tank according to the first embodiment to the holder shown in FIG. 14.
Figure 15C:
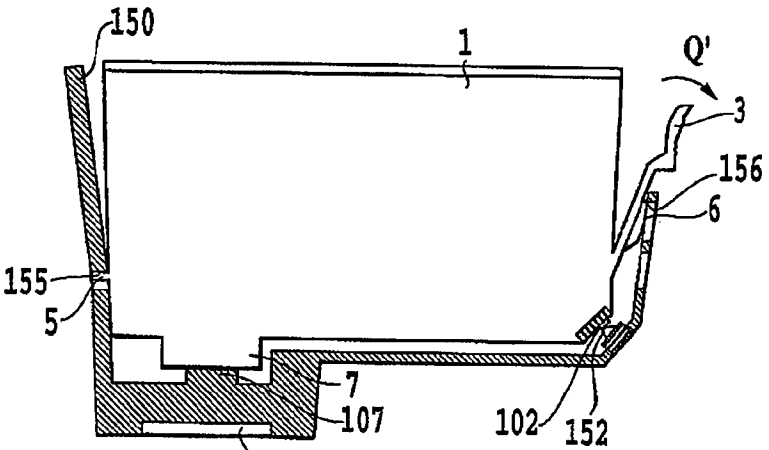
Figure 15A:
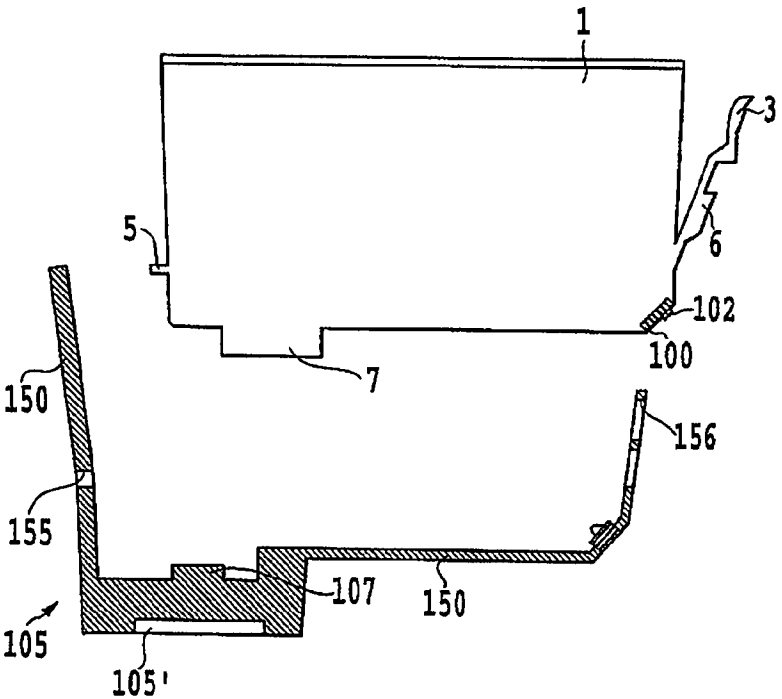

FIG. 14 is a perspective view showing an example of a printing head unit configured to realize attachment and detachment of the ink tanks according to the embodiment shown in FIGS. 1 to 6B. Meanwhile, FIGS. 15A, 15B, and 15C are views for explaining an operation to attach the ink tanks to the printing head unit. In these figures, the light guiding portion 104 is omitted for simplification.

The printing head unit 105 generally includes the holder 150 for detachably holding a plurality (4 pieces in the drawing) of ink tanks, and the printing head 105' (not shown in FIG. 14) to be disposed on a bottom face side. Here, an ink inlet port 107 on the printing head positioned at the bottom of the holder is connected to the ink supply port 7 on the ink tank by attaching each of the ink tanks to the holder 150. In this way, an ink communicating path is formed between the holder and the ink tank.

A component provided with an electrothermal transducer element in a fluid path constituting a nozzle can be used in the printing head 105'. This component is configured to apply thermal energy to the ink by supplying electric pulses constituting printing signals to the electrothermal transducer element, and to utilize pressure generated by a foaming (boiling) phenomenon of the ink attributable to a phase change for ink ejection. Moreover, a contact between an electric contact portion (not shown) for signal transmission formed on a carriage 203 to be described later and an electric contact portion 157 on the printing head unit 105 is established, whereby the printing signals are transmitted to an electrothermal transducer element drive circuit of the printing head 105' through a wiring portion 158. Meanwhile, a wiring portion 159 also extends from the electric contact portion 157 to the connector 152.

The ink tank 1 is handled above the holder 150 (FIG. 15A) when attaching the ink tank 1 to the printing head unit 105. Moreover, the ink tank 1 is placed on the bottom face of the holder while inserting the first engaging part 5 in the shape of a protrusion formed on a back face of the ink tank to the first locking part 155 formed on a back face of the holder (FIG. 15B). Here, when an upper end on the front face side of the ink tank 1 is pressed down as indicated with an arrow P, the ink tank 1 turns in the direction of an arrow R pivotally around a point of engagement between the first engaging part 5 and the first locking part 155, and the front face of the ink tank is gradually displaced downward. In this process, a side face of the second engaging part 6 formed on the supporting member 3 on the front face side of the ink tank is pressed by the second locking part 156, whereby the supporting member 3 is gradually displaced in the direction of an arrow Q as well.

Thereafter, when an upper face of the second engaging part 6 reaches a lower part of the second locking part 156, the supporting member 3 is disposed in the direction of an arrow Q' by its own elasticity, and the second engaging part is locked by the second locking part 156. In this state (FIG. 15C), the second locking part 156 elastically energizes the ink tank 1 in the horizontal direction through the supporting member 3, and the back face of the ink tank 1 abuts on the back face of the holder 150. Meanwhile, displacement to the upside of the ink tank 1 is suppressed by the first locking part 155 engaged with the first engaging part 5 and the second locking part 156 engaged with the second engaging part 6. This is a state where the ink tank 1 is completely attached. At this time, the ink supply port 7 is connected to the ink inlet port 107, and the pad 102 is connected to the connector 152.

Applying the principle of leverage as an example, in the process of the attaching operation as shown in FIG. 15B, the point of engagement between the first engaging part 5 and the first locking part 155 functions as a fulcrum while the front surface of the ink tank 1 functions as a power point. The point of connection between the ink supply port 7 and the ink inlet port 107 functions as a point of action, which is located between the power point and the fulcrum preferably in a position close to the fulcrum. Therefore, the ink supply port 7 is pressed against the ink inlet port 107 by a large force along with the turn of the ink tank 1. An elastic material having relatively fine flexibility such as a filter, an absorbent or a packing is usually disposed at the point of connection between the both constituents in order to ensure ink communication and to prevent ink leakage.

Therefore, it is preferable in light of the purpose of provision to adopt the configuration layout and the attaching operation of this example and to subject those members to elastic deformation by use of a relatively large force. Moreover, when the attaching operation is completed, the first locking part 155 engaged with the first engaging part 5 and the second locking part 156 engaged with the second engaging part 6 prevent the ink tank 1 from rising. Accordingly, restoration of the elastic members is suppressed, and the members are thereby retained at the elastically deformed state.

Meanwhile, the pad 102 and the connector 152 functioning as the contact points are conductive members such as metal having relatively high rigidity, and fine electric connection should be ensured between these members. On the other hand, it is not preferable to allow these members to abut on each other by applying an excessive force from the viewpoints of damage prevention and durability. In this embodiment, the abutting force is favorably reduced by locating these members in the regions as remote from the fulcrum as possible, i.e. in the vicinity of the front face of the ink tank.

In this example, the board 100 is disposed on the inclined face located on the junction of the bottom face and the front face of the ink tank 1 for connecting the both faces to each other. Now, in the state where the pad 102 abuts on the connector 152, equilibrium of force only in terms of this abutting portion will be considered. At this time, a reaction force (a force acting upward in the vertical direction) applied from the connecter 152 to the pad 102 so as to balance with a force of attachment acting downward in the vertical direction is equivalent to a component force of actual abutting pressure (a force acting in a perpendicular direction to the inclined face) between the connector 152 and the pad 102. Therefore, when the user presses the ink tank down to a position for completing attachment, there is only a small increase in the force for attaching the ink tank to establish electric connection between the board and the connector. In addition, operability of the user is not substantially deteriorated.

Moreover, when the ink tank 1 is pressed down to the position for completing attachment (the position where the first engaging part 5 is engaged with the first locking part 155 while the second engaging part 6 is engaged with the second locking part 156), the pressure also generates a component force in the direction parallel to a flat surface of the board 100. This component force is equivalent to a force allowing the pad 102 to slide on the connector 152. Accordingly, it is possible to obtain the completely attached state while ensuring fine electric connection between the both members. Meanwhile, in this state, the electrically connected portion is located in a region higher than the bottom face of the ink tank. Accordingly, there is very little risk of the leaking ink flowing thereon. In addition, it is also possible to ensure the optical axis from the first light emitting portion 101 to the first light receiving portion 210 and to the user's eyes.

In other words, the layout configuration of the electrically connected portion as described in this example is suitable in terms of various aspects such as the magnitude of the attachment force for the ink tank, ensuring the state of electrical contact or protection against the leaking ink.

The configuration of the fixture for the ink tank according to the first embodiment and a relevant modified example of the present invention is not limited to the illustration in FIG. 14.

Another example will be described by use of FIGS. 16A and 16B. FIG. 16A is a perspective view showing an another configuration example of the printing head unit configured to execute a printing operation upon reception of ink supply from the ink tank as well as a carriage for embedding this printing head unit. Meanwhile, FIG. 16B is a perspective views showing the state where the printing head unit is connected to the carriage.

As shown in FIG. 16A, a printing head unit 405 of this example does not include a holder portion corresponding to the front face side of the ink tank and components arranged thereon including the second locking part and the connector unlike the holder 150 of the previous example configured to fix and hold the entire ink tank. Other features are substantially similar to the previous example. Specifically, the ink inlet port 107 to be connected to the ink supply port 7 is provided on the bottom face while the first locking part 155 is provided on the rear face side. In addition, an electric contact point (not shown) for signal transmission is provided on the rear face side thereof.

Figure 16B:
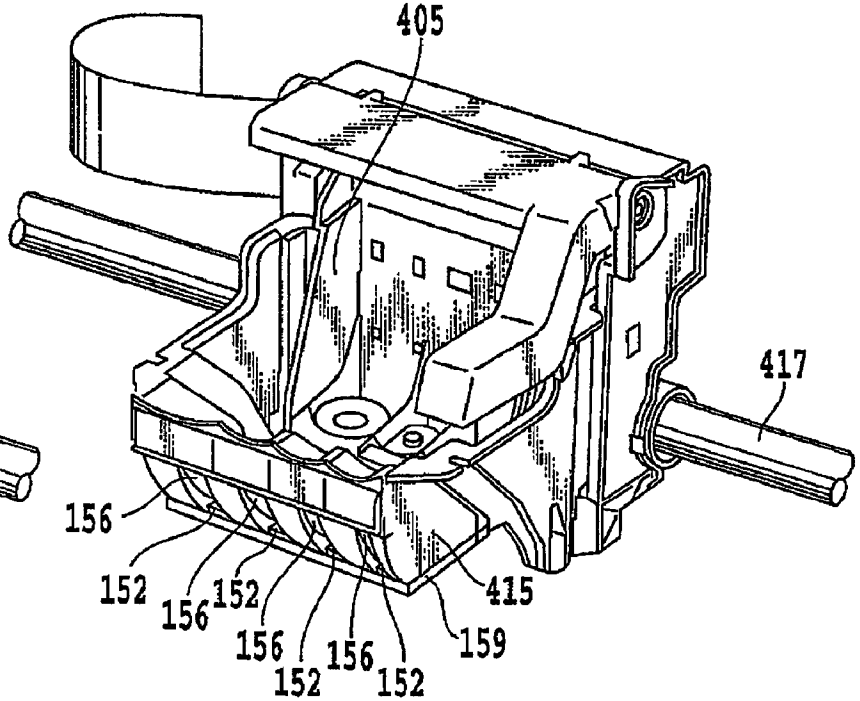
FIGS. 16A and 16B are perspective views showing another example of a structure of a fixture for the ink tanks according to the first embodiment.
Figure 16A:
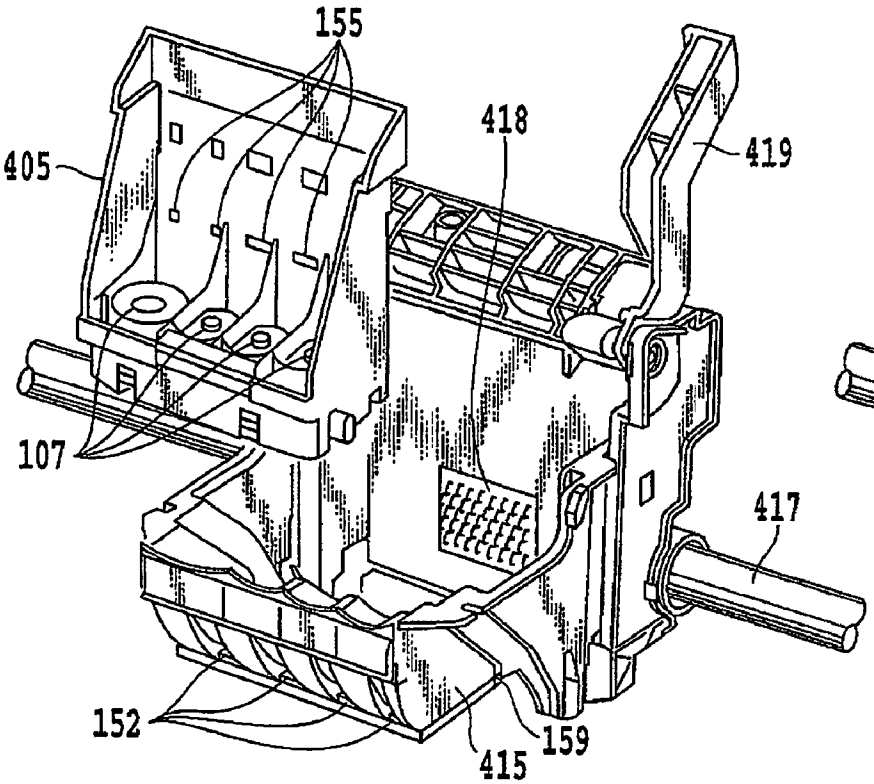

Meanwhile, as shown in FIG. 16B, a carriage 415 which is rendered movable along a shaft 417 includes a lever 419 for attaching and fixing the printing head unit 405, and an electric contact portion 418 connected to the electric contact portion on the printing head. In addition, the carriage 415 also includes a holder portion corresponding to the structure of the front face of the ink tank. Specifically, the second locking parts 156, the connectors 152, and the wiring portion 159 for the connectors are provided on the carriage.

In this configuration, the fixture for the ink tanks is constructed as a whole when the printing head unit 405 is attached to the carriage 415. That is, an attaching operation is completed by connecting the ink supply port 7 to the ink inlet port 107 while the pad 102 is connected to the connector 152 by way of an attaching operation similar to FIGS. 15A to 15C.

1.3. Printing Apparatus (FIGS. 17 and 18)

Figure 17:
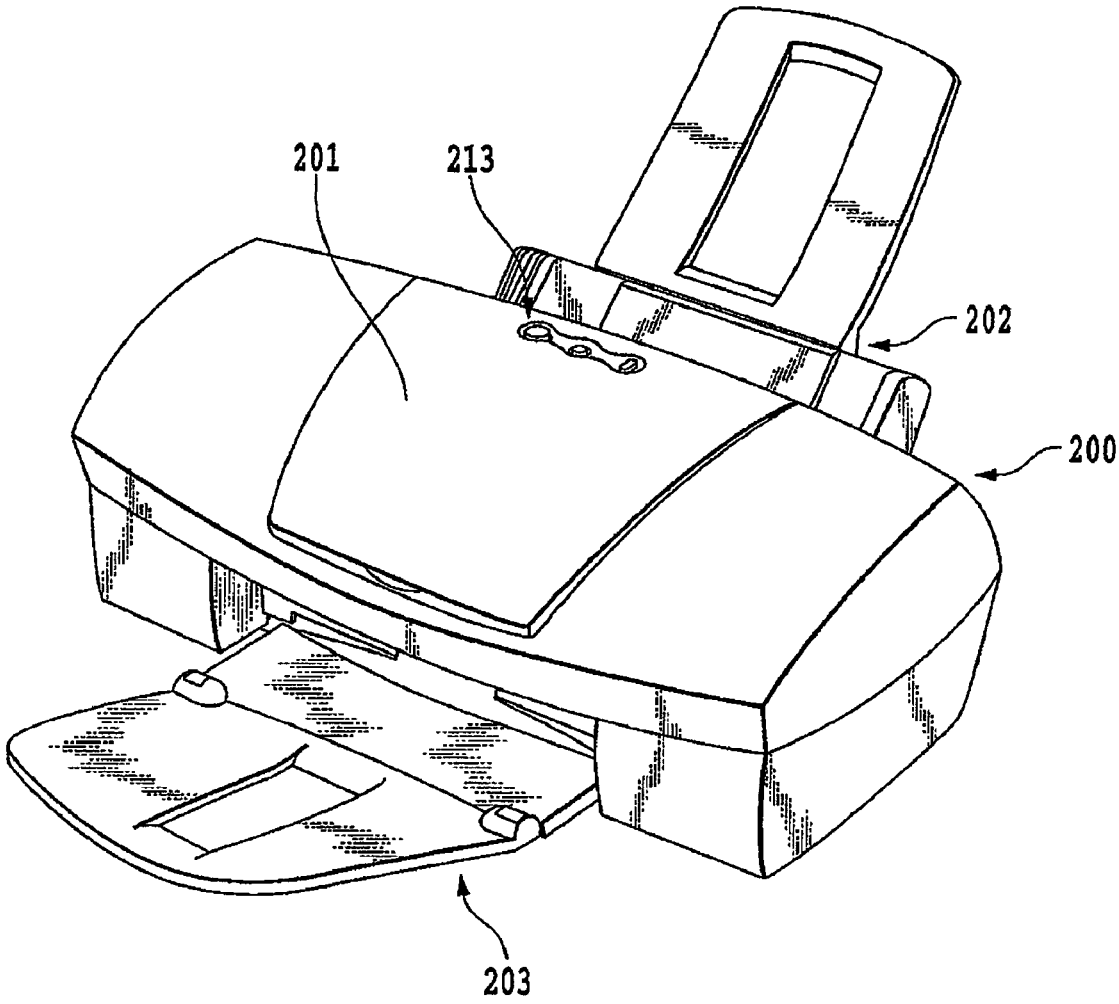
FIG. 17 is a view showing appearance of an ink jet printer configured to perform printing while attaching the ink tanks according to the first embodiment.
Figure 18:
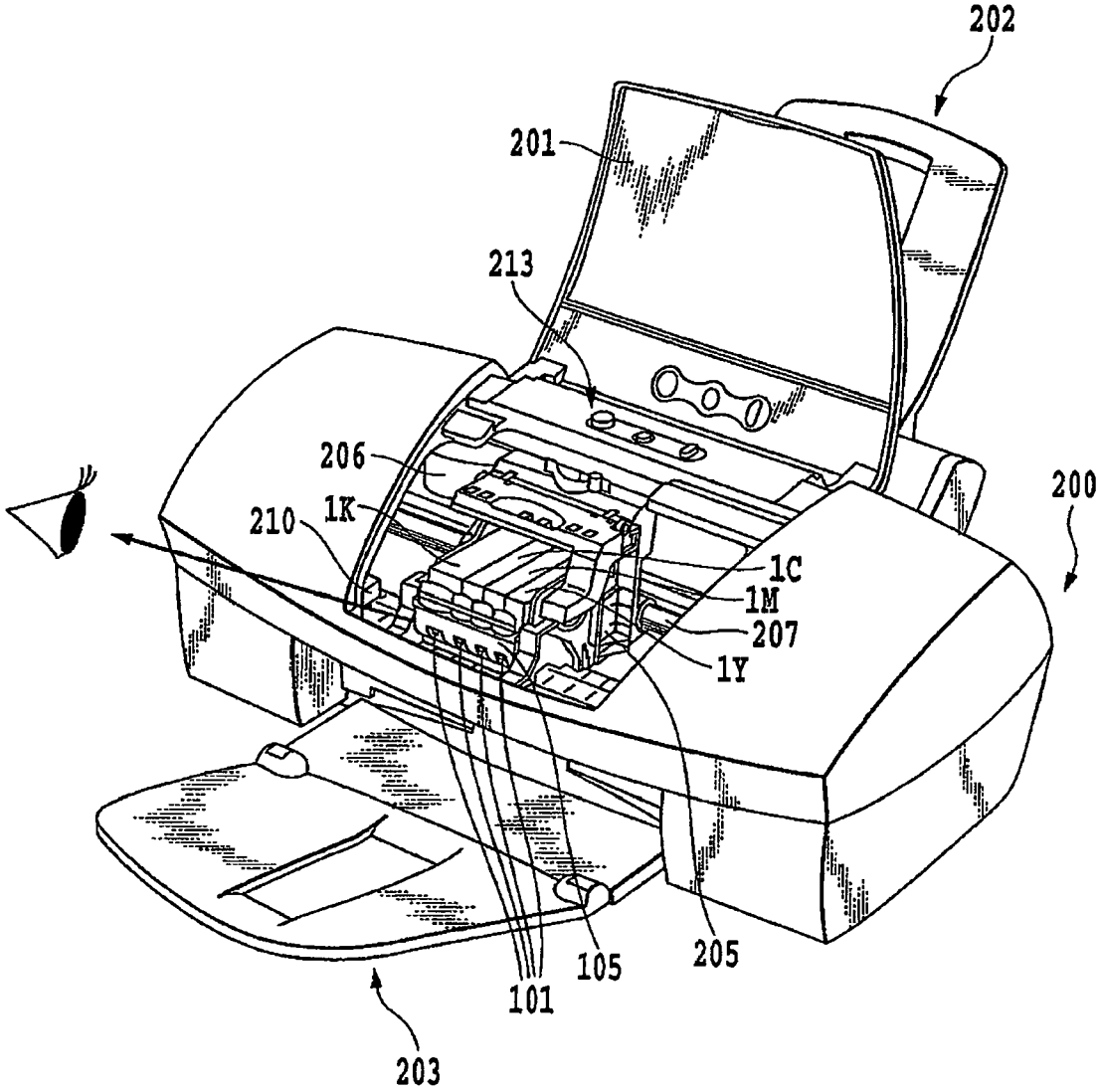
FIG. 18 is a perspective view showing a state where a body cover 201 illustrated in FIG. 17 is open.

FIG. 17 is a view showing appearance of an ink jet printer 200 configured to perform printing while attaching the above-described ink tanks, and FIG. 18 is a perspective view showing a state where a body cover 201 illustrated in FIG. 17 is opened.

As shown in FIG. 17, the printer 200 of this embodiment includes a printer body constituting a principal part of the printer including a mechanism for allowing the carriage mounting the printing head and the ink tanks to travel for scanning and to execute printing. The printer body is covered with the body cover 201 and other casing portions. Moreover, the printer 200 of this embodiment includes a sheet-discharge tray 203 and an automatic sheet feeder (ASF) 202 which are respectively placed in front and back of the printer body. Further, the printer 200 includes a console unit 213. Here, the console unit 213 includes an indicator for indicating the condition of this printer both in the state where the body cover is closed and in the state where the body cover is opened, a power switch, and a reset switch.

When the body cover 201 is in the open state, as shown in FIG. 18, the user can observe a moving range of the carriage 205 mounting the printing head unit 105 and ink tanks 1K, 1Y, 1M, and 1C, and the surrounding area of that range. In the following, the ink tanks 1K, 1Y, 1M, and 1C may be indicated with a single reference numeral of "1" when appropriate. Actually, when the body cover 201 is opened, a sequence for moving the carriage 205 automatically to a substantially central position in the drawing (this position will be hereinafter referred to as a "tank replacement position") is executed, whereby the user can perform replacing operations of the respective ink tanks and the like in this tank replacement position.

In the printer of this embodiment, the printing head unit 105 includes chip-shaped printing heads (not shown) corresponding to the respective colors of ink. Moreover, the printing heads for the respective colors perform scanning on a printing medium such as paper by means of movement of the carriage 205, and perform printing by ejecting the ink onto the printing medium in the course of scanning. Specifically, the carriage 205 is slidably engaged with a guide shaft 207 extending in the direction of movement thereof, and is able to move as described above by use of a carriage motor and a drive force transmission mechanism thereof. Then, ink ejection is performed by the respective printing heads corresponding to the ink in the colors of K. Y, M, and C based on ejection data transmitted from a control circuit on the body's side through a flexible cable 206. Meanwhile, paper feeding mechanisms including a paper feed roller and a paper discharge roller are provided, and it is thereby possible to convey the printing medium (not illustrated) fed from the automatic sheet feeder 202 to the sheet-discharge tray 203. Moreover, the printing head unit 105 incorporating the ink tank holder is detachably attached to the carriage 205. Meanwhile, each of the ink tanks 1 is detachably attached to this printing head unit 105 in the form of a cartridge. That is to say, it is possible to attach the printing head unit 105 to the carriage 205 and further to attach the ink tanks 1 to the printing head unit 105. In this embodiment, the ink tanks 1 are detachable from the carriage 205 through the printing head unit 105.

In the printing operation, the printing heads perform scanning by means of the above-described movement. In the course of scanning, the respective printing heads eject the ink onto the printing medium and thereby perform printing in a region of width corresponding to nozzles in the printing heads. Then, at an interval between this scanning operation and the next scanning operation, the paper is sent in a given amount corresponding to the width by the paper feeding mechanisms, whereby the printing medium is sequentially printed. Meanwhile, on an end in the moving range of the printing heads attributable to the above-described cartridge movement, there is provided an ejection recovery unit such as caps for covering faces of the respective printing heads on which the nozzles are formed. In this way, the printing heads move to the position where the recovery unit is provided at a given time interval and are subjected to a recovery process such as preliminary ejection.

As described previously, the printing head unit 105 including tank holder portions for the respective ink tanks 1 is provided with the connectors corresponding to the respective ink tanks. Each of the connectors contacts the pad on the board provided on the ink tank 1 to be attached thereto. In this way, it is possible to control lighting or blinking of each LED 101 in accordance with sequences to be described later with reference to FIG. 25 to FIG. 27.

To be more precise, in the above-described tank replacement position, the LED 101 of the ink tank is either turned on or caused to blink when ink residual quantity of the relevant ink tank 1 is reduced. Meanwhile, the light receiving portion 210 including a photodetector is provided in the vicinity of an end in the moving range of the carriage on the opposite side of the position where the above-described recovery unit is provided. Then, the LEDs 101 of the respective ink tanks 1 are subjected to light emission when the LEDs 101 pass this light receiving portion 210 along with the movement of the carriage 205. In this way, it is possible to detect positions of the respective ink tanks 1 in the carriage 205 based on the position of the carriage 205 at the time of receiving the light. In addition, as another example of controlling blinking and the like of the LEDs, the LED 101 of each of the ink tanks 1 is controlled to blink when the ink tank 1 is properly attached. These control operations are executed as similar to the control for ink ejection from the printing heads, namely by transmitting control data (control signals) from the control circuit on the body to the respective ink tanks through the flexible cable 206.

2. Structure of Control System 2.1. Overall Structure (FIG. 19)

Figure 19:
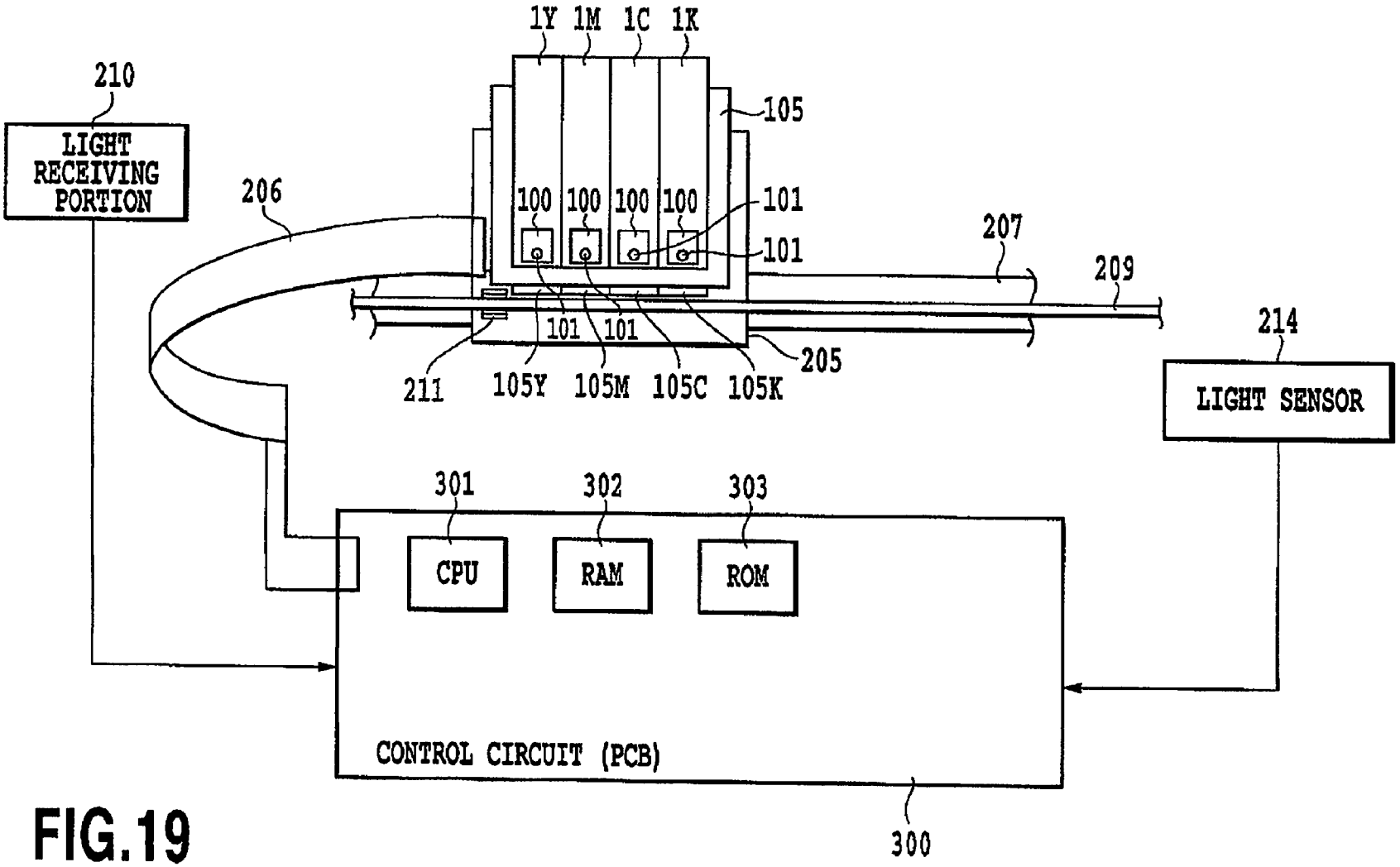
FIG. 19 is a block diagram showing a control structure of the ink jet printer.

FIG. 19 is a block diagram showing an example of a structure of control system for the above-described ink jet printer. This drawing mainly illustrates a control circuit in the form of a printed circuit board (PCB) in the printer body, and a structure concerning light emission of the first light emitting portion (hereinafter also referred to as the LED) of the ink tank to be controlled by the control circuit.

In FIG. 19, a control circuit 300 executes data processing and operation control concerning the printer. To be more precise, a central processing unit (CPU) 301 executes the processing to be described later with reference to FIG. 25 to FIG. 27 and FIG. 31, and the like in accordance with a program stored in a read-only memory (ROM) 303. Meanwhile, a random access memory (RAM) 302 is used as a work area during execution of the processing by the CPU 301.

As schematically illustrated in FIG. 11, the printing head unit 105 mounted on the carriage 205 includes printing heads 105K, 105Y, 105M, and 105C. Each of the printing heads 105K, 105Y, 105M, and 105C is provided with a plurality of nozzles for ejecting the ink in any of black (K), yellow (Y), magenta (M), and cyan (C). Moreover, the ink tanks 1K, 1Y, 1M, and 1C are detachably mounted on the holder of the printing head unit 105 corresponding to these printing heads.

As described above, the board 100 provided with the LED 101, the display control circuit therefor, and the pad functioning as a contact terminal are mounted on each of the ink tanks 1. Moreover, when the ink tank 1 is properly attached to the printing head unit 105, the pad on the board 100 contacts the connector provided on the printing head unit 105 corresponding to each of the ink tanks 1. Meanwhile, a connector (not shown) provided on the carriage 205 is subjected to signal connection to the control circuit 300 on the body through the flexible cable 206. In addition, as the printing head unit 105 is attached to the carriage 205, the connector of the carriage 205 is subjected to signal connection to the connector of the printing head unit 105. By the above-described configuration of connection, it is possible to transmit signals between the control circuit 300 on the body and the respective ink tanks 1. In this way, the control circuit 300 can control lighting and blinking in accordance with the sequences to be described later with reference to FIG. 25 to FIG. 27.

Ink ejection of the respective printing heads 105K, 105Y, 105M, and 105C is similarly controlled. Specifically, drive circuits and the like that are provided on the respective printing heads are subjected to signal connection to the control circuit 300 on the body through the flexible cable 206, the connector of the carriage 205 and the connector of the printing head unit. In this way, the control circuit 300 can control ink ejection and other operations by the respective printing heads.

The light receiving portion 210 provided in the vicinity of one end in the moving range of the carriage 205 receives the light emitted from the LED 101 of the ink tank 1 and then outputs a corresponding signal to the control circuit 300. As will be described later, the control circuit 300 can determine the position of each of the ink tanks 1 relative to the carriage 205 based on this signal. Meanwhile, an encoder scale 209 is provided along the moving path of the carriage 205, and an encoder sensor 211 is provided on the carriage 205. A detection signal of this sensor is inputted to the control circuit 300 through the flexible cable 206. In this way, it is possible to determine the moving position of the carriage 205. This positional information is used for ejection control of the respective printing heads and in an optical checking process for detecting the positions of the ink tanks to be described later with reference to FIG. 25 and the like. In addition, a light sensor 214 to be placed in the vicinity of a given position within the moving range of the carriage, that is, to be located at a position opposing to the prism shaped detection target 17 on the ink tank, includes a light emitting element and a photodetector. However, the light sensor according to the embodiments as shown in FIGS. 10 to 13 needs no light emitting element. The light sensor 214 outputs signal concerning the ink residual quantity in terms of each of the ink tanks 1 to be mounted on the carriage 205 to the control circuit 300. Accordingly, the control circuit 300 can detect the ink residual quantity based on this signal.

2.2. Structures of Connectors (FIG. 20 to FIG. 24)

Figure 20:
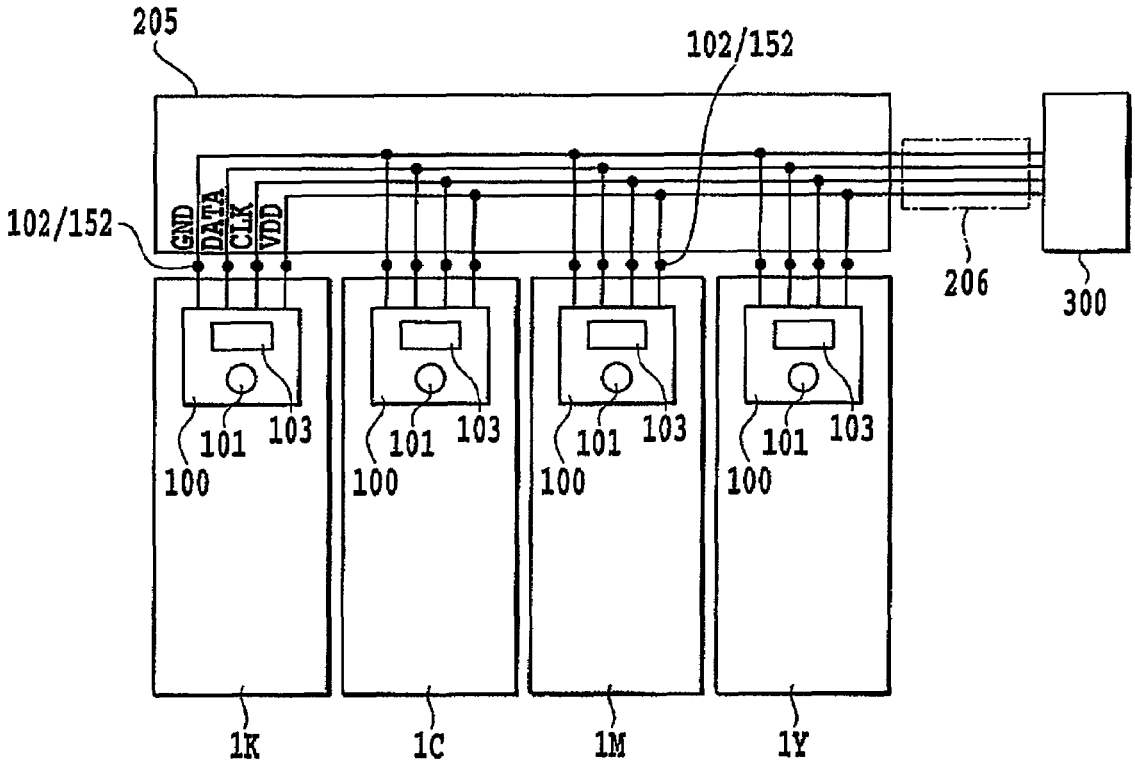
FIG. 20 is a view showing structures of signal lines in a flexible cable of the ink jet printer used for signal connection to the ink tanks, which is illustrated in terms of relations with boards on the respective ink tanks.

FIG. 20 is a view showing structures of signal lines in the flexible cable 206 used for signal connection to the ink tanks 1, which is illustrated in terms of relations with boards 100 on the respective ink tanks.

As shown in FIG. 20, the signal lines for the ink tank 1 consist of four signal lines. Moreover, these signal lines are shared by the four ink tanks 1 (so-called bus connection). Specifically, the signal lines for the respective ink tanks 1 include a power signal line "VDD" involved in power supply for operations and the like of the control portion 103 configured to perform light emission and drive control of the LEDs 101 in the ink tanks, and a ground signal line "GND". Moreover, as will be described later, the signal lines include a signal line "DATA" for transmitting control signals (control data) concerning lighting and blinking processes of the LEDs 101 from the control circuit 300, and a clock signal line "CLK" for the operations. Although this embodiment will be described on the basis of the four signal lines, the present invention is not limited to this configuration. For example, it is possible to omit the "GND" line by achieving the ground signal by use of a different structure. Moreover, it is also possible to use the single line as the "CLK" signal line and as the "DATA" line.

On the other hand, the board 100 of each of the ink tanks 1K, 1Y, 1M, and 1C includes the control portion 103 to be operated by the signals from these four signal lines, and the LED 101 as the light emitting portion to be operated under control by the control portion 103.

Figure 21:
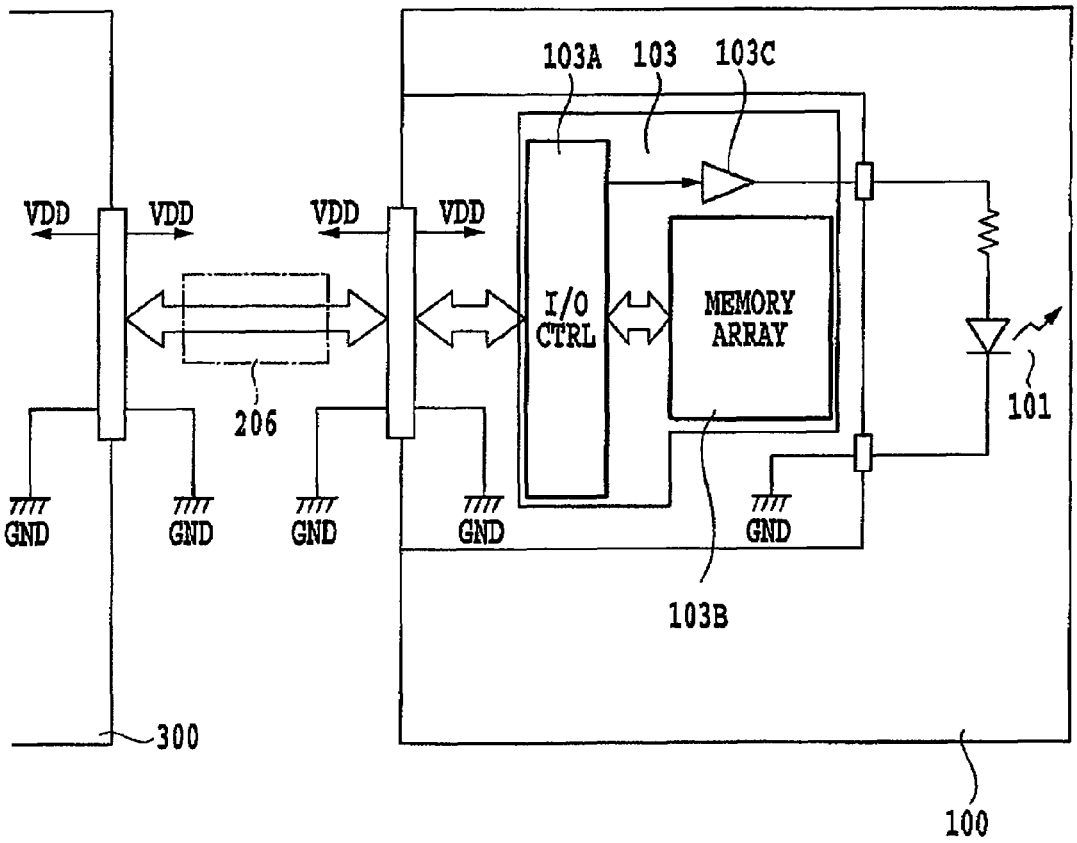

FIG. 21 is a circuit diagram showing details of the board according to an embodiment provided with the control portion and the like. As shown in the drawing, the control portion 103 has an input and an LED driver 103C. The input and output control circuit 103A controls display drive of the LED 101, and controls data writing and reading in and out of the memory array 103B in response to the control data to be transmitted from the control circuit 300 on the body through the flexible cable 206. In this embodiment, the memory array 103B is an EEPROM which can store the ink residual quantity, color information on the contained ink, manufacturing information of the ink tank such as a specific number or a manufacturing lot number, and the like. The color information to be stored in the memory array 103B is written into a predetermined address in the memory array 103B corresponding to the ink color at the time of shipping or the manufacturing the ink tank. As will be described later with reference to FIG. 23 and FIG. 24, this color information is used as identification information (individual information) of the ink tank. By using this identification information, it is possible to write the data in the memory array 103B in the specified ink tank or to read the data out of the memory array 103B. Moreover, it is possible to control turning the LED 101 of the relevant ink tank on and off. In addition, the data to be written in or read out of the memory array 103B further include data on the ink residual quantity. As described previously, the detection target 17 in the prism shape is formed on the bottom of the ink tank of this embodiment. When the ink residual quantity is reduced, it is possible to optically detect such reduction by use of this detection target 17. In addition, in this embodiment, the control circuit 300 counts the number of ejection depending on the printing head based on ejection data, and calculates the ink residual quantity in each of the ink tanks based on the counted number of ejection. Thereafter, the control circuit 300 writes this residual quantity information severally in the memory array 103B in the corresponding ink tank and reads out the information therefrom. In this way, the memory array 103B can retain the present-time information on the ink residual quantity. This information may be used for detection of the residual quantity at higher accuracy by a combination of the ink residual quantity detection applying the detection target 17 in the prism shape, or for judging as to whether the attached ink tank is a new one or a reattached one, for example.

The LED driver 103C is operated to apply a power voltage to the LED 101 when an on signal is outputted from the input and output control circuit 103A, thereby allowing the LED 101 to emit the light. Therefore, the LED 101 continues to be turned on when the signal outputted from the input and output control circuit 103A is set to an on-state. On the contrary, the LED 101 continues to be turned off when the signal is set to an off-state.

Figure 22:
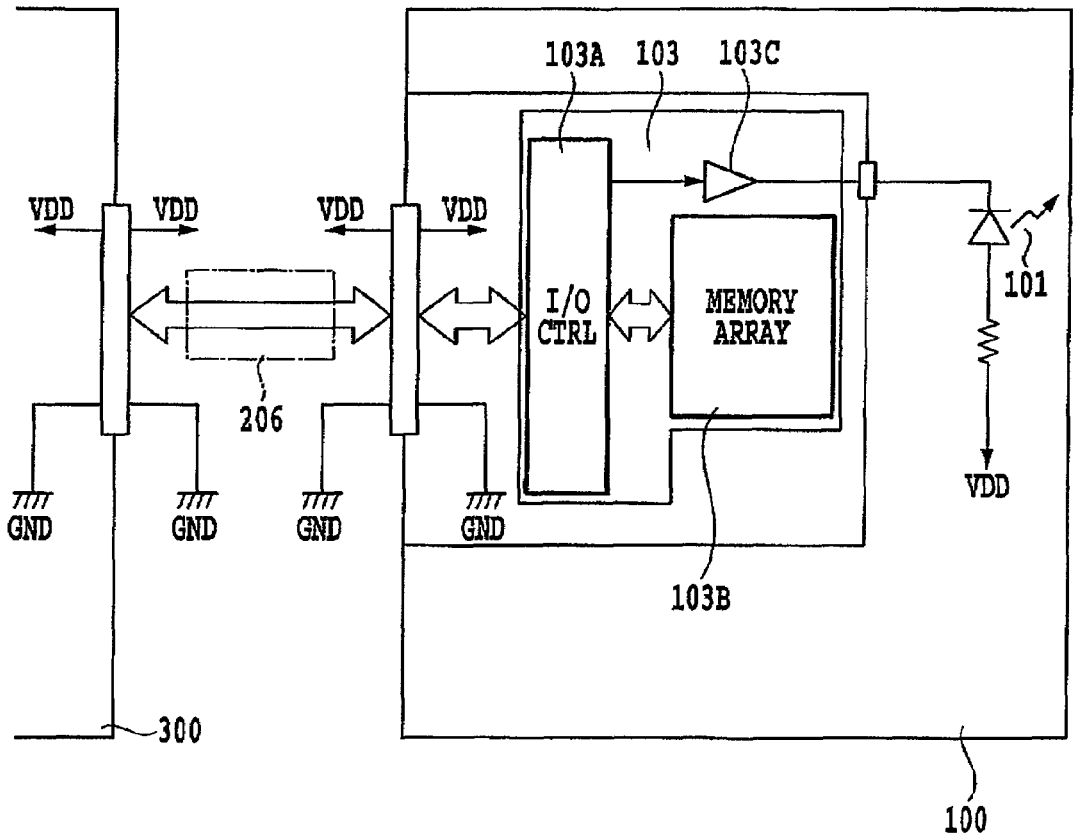
FIG. 22 a circuit diagram showing details of another example of the board shown in FIG. 21.

FIG. 22 is a circuit diagram showing a modified example of the configuration of the board 100 shown in FIG. 21. This modified example is different from the example of FIG. 21 in that the electric power is supplied from the VDD power source pattern formed inside the board 100 of the ink tank in the configuration to apply the power supply voltage to the LED 101. The control portion 103 is generally formed integrally on the semiconductor substrate. Accordingly, a connection terminal on this semiconductor substrate is limited to an LED connection terminal in this case. Reduction in the number of connection terminals has a large impact on the space occupancy of the semiconductor substrate, and therefore leads to cost reduction in the semiconductor substrate.

Figure 23:
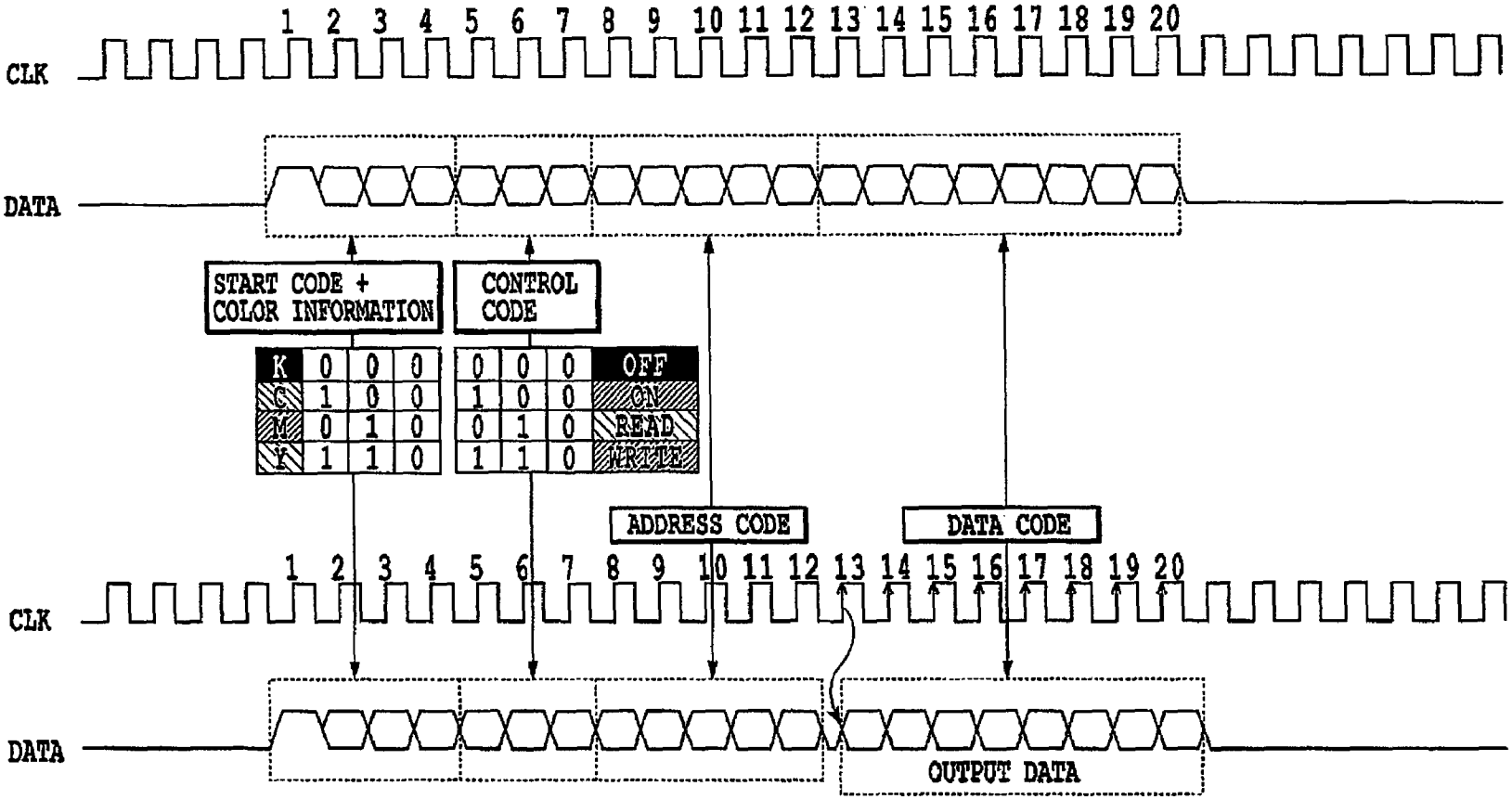
FIG. 23 is a timing chart for explaining operations for writing and reading data in and out of the memory array of the board.
Figure 24:
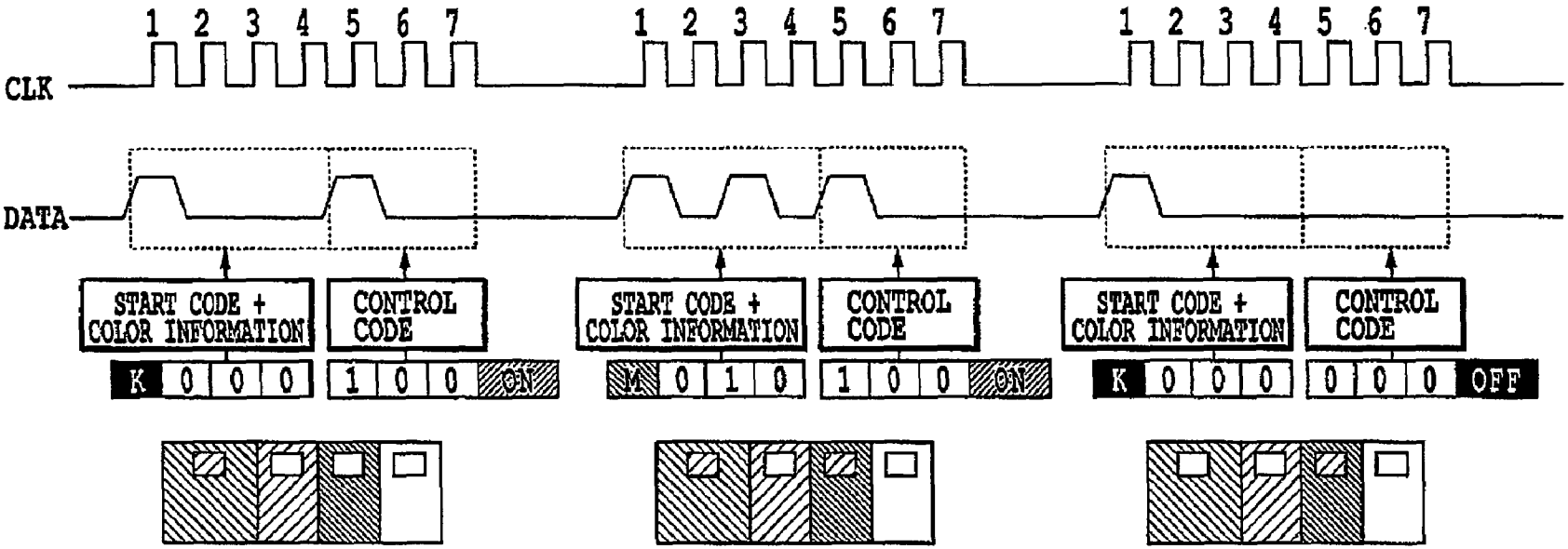
FIG. 24 is a timing chart for explaining operations for turning a light emitting portion (LED) on and off.

FIG. 23 is a timing chart for explaining operations for writing and reading data in and out of the above-described non-volatile memory 103B and FIG. 24 is a timing chart for explaining operations for turning the LED 101 on and off.

As shown in FIG. 23, when writing in the memory array 103B, the following data signals are sent from the control circuit 300 on the body to the input and output control circuit 103A in the control portion 103 of the ink tank 1 through the signal line DATA (see FIG. 20). Specifically, the respective data signals representing "start code+color information," "control code," "address code," and "data code" are sent in this order synchronously with a clock signal CLK. The "start code+color information" signifies a start of a series of data signals by use of the "start code" signal therein, and specifies the ink tank subject to the series of data signals by use of the "color information" signal. Here, the word "color" represents not only a color of ink such as Y, M, C, but density.

The "color information" includes codes corresponding to the ink colors of "K," "C," "M," or "Y." The input and output control circuit 103A compares the color information indicated by any of the above codes with its own color information stored in the memory array 103B. Then, the input and output control circuit 103A performs a process to retrieve subsequent data signals only when two pieces of the color information coincide with each other. When the two pieces of the color information do not coincide with each other, the input and output control portion 103A performs a process to stop or ignore subsequent data signals. In this way, even when the data signals are transmitted from the body to the respective ink tanks in common by use of the common signal line "DATA" shown in FIG. 20, it is possible to specify the relevant ink tank by incorporating the above-described color information. Therefore, it is possible to execute various processes such as writing, reading or turning the LED on and off based on the subsequent data signals only in terms of the specified ink tank. As a result, it is possible to perform control for turning the LED on and off in addition to data writing by use of the data transmitted through the common (single) data signal line provided for four ink tanks, and thereby to reduce the number of signal lines required for controlling these ink tanks. Here, it is obvious from the foregoing explanation that the structure applying the common (single) data signal line can be similarly embodied irrespective of the number of ink tanks.

As shown in FIG. 23, the "control codes" in this embodiment includes codes "off" and "on" respectively used for control to turn the LED on and off to be described later, and codes "read" and "write" respectively indicating actions of reading from and writing to the memory array. In the writing action, the code "write" follows the code "color information" that specifies the ink tank. The subsequent "address code" indicates the address of the memory array subject to the writing action, and the last "data code" represents the contents subject to writing.

Here, it is needless to say that the contents to be represented by the "control codes" for memory access are not limited only to the foregoing examples. For example, it is also possible to use an additional control code concerning a "verify" command, a "continuous read" command or the like.

In the reading action, the configurations of the data signals are identical to those in the writing action. Meanwhile, the code "start code+color information" is received by the input and output control circuits 103A of all the ink tanks, and the subsequent data signals are received only by the input and output control circuit 103A of the ink tank having the matching "color information". The difference is that the readout data are outputted synchronously with a leading edge of the first clock pulse (which is the 13th clock pulse in FIG. 23) after address designation in accordance with the address code. Even when the data signal terminals of the multiple ink tanks are connected to the common (single) data signal line, the input and output control circuits 103A perform arbitration so as to avoid conflicts of the readout data with other input signals.

When turning the LED 101 on and off, as shown in FIG. 24, the data signal "start code+color information" is firstly sent from the body to the input and output control circuit 103A through the signal line "DATA" as similar to the foregoing operation. As described previously, the ink tank is specified by the "color information" and the control for turning the LED 101 on and off based on the "control code" to be transmitted later is executed only in terms of the specified ink tank. As shown in FIG. 23, the "control code" concerning tuning on an off includes an "on" code and an "off" code. The LED 101 is turned on by the "ON" code and turned off by the "OFF" code. That is, when the control code is equivalent to the "on" code, the input and output control circuit 103A outputs an on signal to the LED driver 103C as described previously in FIG. 22 and maintains that output state thereafter. On the contrary, when the control code is equivalent to the "off" code, the input and output control circuit 103A outputs an off signal to the LED driver 103C and maintains that output state thereafter. Here, actual timing for tuning the LED 101 on or off takes place after the first clock (which is the 8th clock in FIG. 23) after completion of the control code in terms of each data signal shown in FIG. 24.

In the example shown in the drawing, the ink tank containing the black ink K is specified in the beginning as represented by the data signal on the left end in the drawing. Accordingly, the LED 101 of the tank for the ink K is turned on. Next, the "color information" in the second data signal designates the magenta ink M and the "control code" thereof instructs to turn the LED 101 on. Therefore, the LED 101 of the tank for the ink M is turned on while leaving the LED 101 of the tank for the ink K turned on as well. Moreover, in the third data signal, the "control code" instructs to turn the LED 101 off in terms of the ink tank for the ink K. Therefore, only the LED 101 of the tank for the ink K is turned off.

As it is apparent from the foregoing explanation, blink control of the LED is made possible by transmitting the data signals respectively including the "control codes" for turning the LED on and off while specifying the target ink tank. In this case, it is possible to control a blink cycle by defining a cycle of transmission of the signals.

2.3. Control Procedures (FIGS. 25 to 31)

Figure 25:
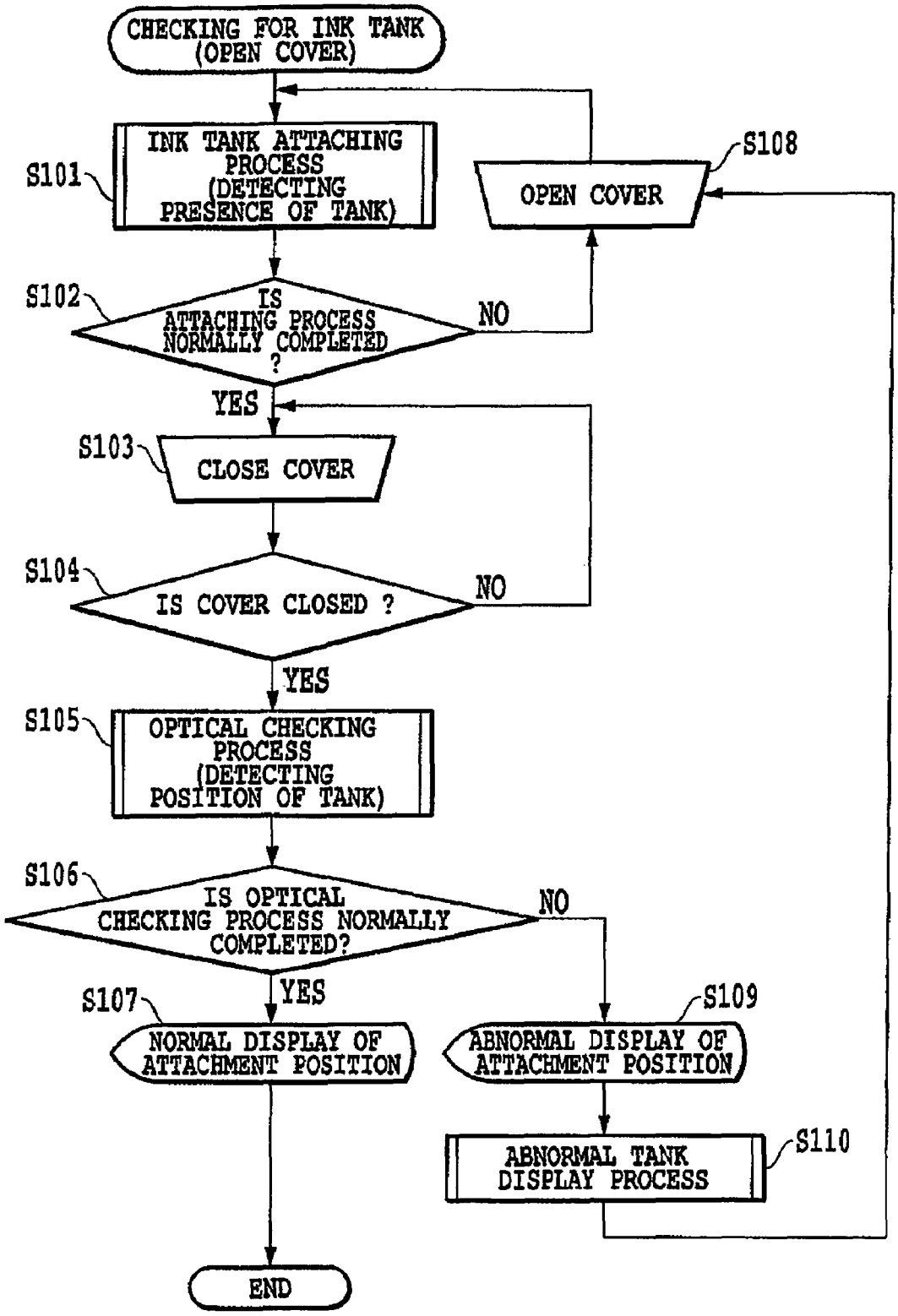
FIG. 25 is a flowchart showing control procedures for attaching an ink tank according to an embodiment of the present invention.

FIG. 25 is a flowchart showing control procedures for attaching or replacing the ink tank based on the configuration of the above-described embodiment. More specifically, FIG. 25 shows control for tuning the respective LEDs 101 for the ink tanks 1K, 1Y, 1M, and 1C on and off by use of the control circuit 300 on the body.

When the user opens the body cover 201 of the printer of this embodiment, a predetermined sensor detects such an action and initiates the process shown in FIG. 25. Upon initiation of this process, an ink tank detaching and attaching process is firstly executed in Step S101.

Figure 26:
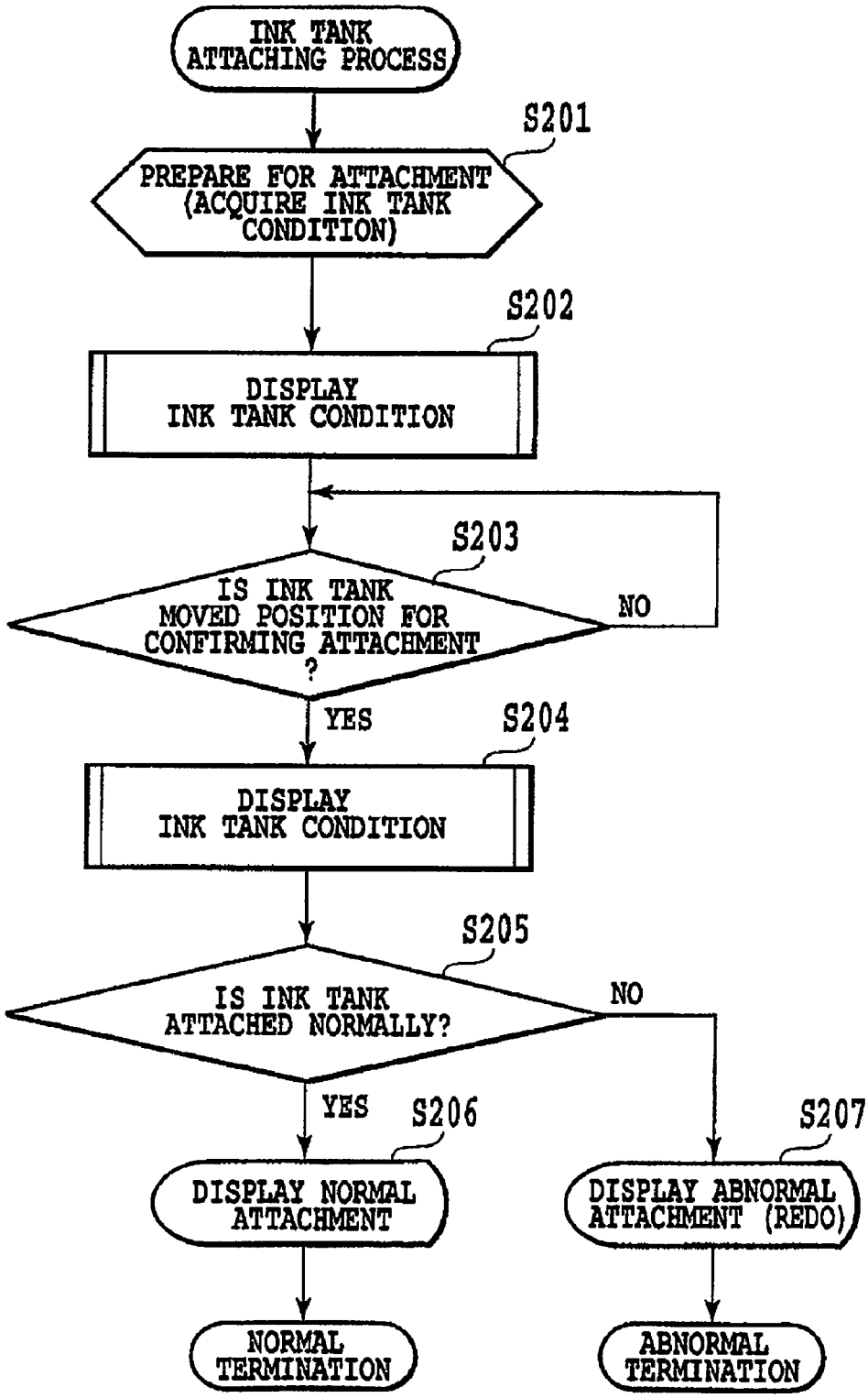
FIG. 26 is a flowchart showing details of the ink tank attaching process shown in FIG. 25.

FIG. 26 is a flowchart showing details of this ink tank detaching and attaching process. As shown in the drawing, in the detaching and attaching process, the carriage 205 is firstly moved in Step S201 and condition information on the respective ink tanks (individual information on the ink tanks) mounted at that time is acquired. The information to be acquired includes the ink residual quantities at that time, for example. The information is read out of the memory array 103B together with individual numbers of the ink tanks. Then, in Step S202, a judgement is made as to whether or not the carriage 205 reaches the ink tank replacement position as described in FIG. 18.

When the judgement is affirmative, control for confirming attachment of the ink tanks is executed in Step S204.

Figure 27:
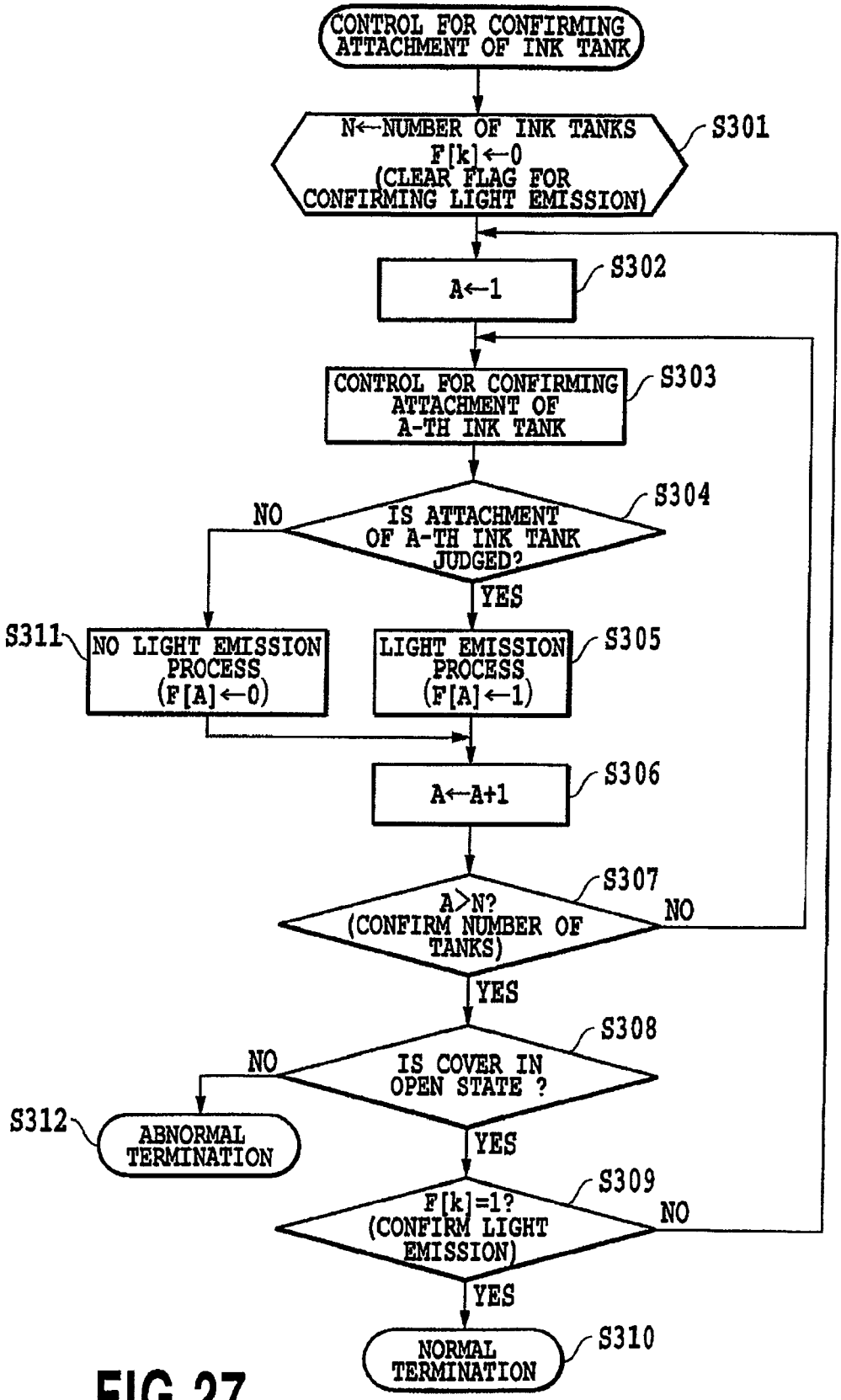
FIG. 27 is a flowchart showing a detailed example of attachment confirmation control in FIG. 26.

FIG. 27 is a flowchart showing details of the control for attachment confirmation. Firstly, in Step S301, a parameter N indicating the number of ink tanks to be mounted on the carriage 205 is set up and a flag F (k) for visually checking light emission of the LEDs in response to the number of the ink tanks is also initialized. In this embodiment, the parameter N is set to "4" so as to represent the number of the ink tanks for K, C, M, and Y. Accordingly, four flags of F (k): k=1 to 4 are prepared and all the contents thereof are initialized to "0."

Next, in Step S302, a variable A concerning the order for judging attachment of the ink tanks in each of the flags is set to "1." Then, attachment confirmation control is performed in terms of an A-th ink tank (which is the first ink tank in the beginning) in Step S303. This control is carried out in order to allow the user to confirm that the ink tank is fitted in the proper position of the holder 150 of the printing head unit 105. Specifically, when the contact 152 of the holder 150 is connected to the contact 102 of the ink tank, the control circuit 300 on the body designates the ink tank firstly by use of the color information representing the individual information on the ink tank as described previously. Thereafter, the color information stored in the memory array 103B of the designated ink tank is sequentially read out. Here, it is needless to say that the color information for specification is not used in terms of those which have been read out already. In addition, this control process also judges whether or not the color information thus read out is different from the color information which has been previously read out after starting this process.

Then, in Step S304, when the color information thus read out is different from the information which was previously read out, the judgment is made that the ink tank having the color information is attached as the A-th ink tank. In any other cases, the judgment is made that the A-th ink tank is not attached. Here, the A-th ink tank explained herein merely describes the order of judgment of the ink tank but does not represent the order indicating the position of attachment of the ink tank. When the judgment is made that the A-th ink tank is attached, the content of the relevant flag F (A), i.e. one of the four flags F (k): k=1 to 4 corresponding to the case where k=A, is set to "1" in Step S305. In this way, the LED 101 of the ink tank 1 having the relevant color information is turned on as described previously with reference to FIG. 24. When the judgment is made that the A-th ink tank is not attached, then, the content of the relevant flag F (A) is set to "0" in Step S311.

Next, in Step S306, the variable A is incremented by 1. Then, a judgment is made in Step S307 as to whether or not this variable A is greater than the parameter N (which is equal to 4 in the case of the printer of this embodiment) set up in Step S301. Here, when the judgment is made that the variable A is equal to or below the parameter N, the processes starting from Step 303 are repeated. On the other hand, when the judgment is made that the variable A is greater than the parameter N, as the control for attachment confirmation is completed for all ink tanks, in Step S308, a judgment is made as to whether or not the cover 201 is in the open state based on the output from the above mentioned sensor. When the judgment is made that the body cover 201 is in the closed state in Step S308, there is a possibility that the user closed the body cover 201 without attaching some of the ink tanks or with the incomplete attachment of the ink tank. In this case, a status indicating abnormality is sent to the routine of FIG. 26, then this process is terminated.

When the judgment is made that the body cover 201 is in the open state in Step S308, a judgment is made as to whether or not all the contents in the four flags F(k); k=1 to 4, are equal to "1", or in other words, whether or not the LEDs 101 on all the ink tanks are turned on. When a judgment is made that any of the LEDs 101 of the ink tanks is not turned on, the processing in Step S302 and thereafter is repeated. That is, the user attaches the ink tank of which the LED 101 is not turned on or retries the attaching operations. This processing will be repeated until the relevant LED is finally turned on.

Figure 28A:
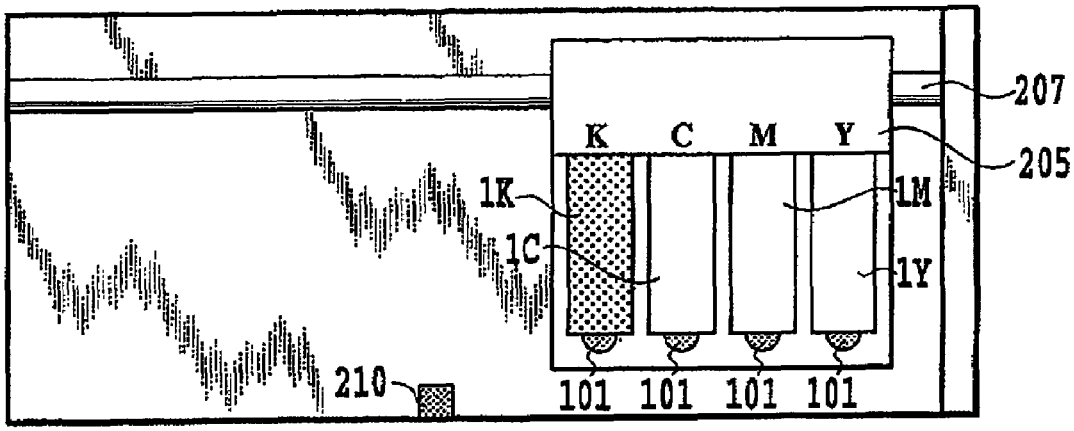

When the judgment is made that the LEDs of all the ink tanks are turned on, a normal terminating process is executed in Step S310 and then this process is terminated. Thereafter, the process returns to the process routine shown in FIG. 26. FIG. 28A is a view showing a state where all the ink tanks are properly attached and the respective LEDs are turned on.

Referring to FIG. 26 again, after executing the control for attachment confirmation in Step S203 as described above, a judgment is made in Step S204 as to whether or not the control is terminated normally, i.e. as to whether or not the ink tanks are attached normally. When the judgment is made that the ink tanks are attached normally, the indicator (see FIGS. 17 and 18) of the console unit 213 is lighted in green in Step S205, for example. Then, the process is normally terminated in Step S206 and returns to the process routine shown in FIG. 25. On the contrary, when the judgment is made that the ink tanks are attached abnormally, the indicator of the console unit 213 is lighted in orange in Step S207, for example. Then, the process is abnormally terminated in Step S208 and returns to the process routine shown in FIG. 25. When a host personal computer (PC) is connected for controlling the printing apparatus, it is also possible to perform abnormal attachment display through a PC monitor at the same time.

In FIG. 25, upon completion of the ink tank detaching and attaching process in Step S101, a judgment is made in Step S102 as to whether or not the detaching and attaching process is terminated normally. Upon a judgment of abnormal termination, the processing stands by in Step S108 until the body cover 201 is opened by the user. When the user opens the cover 201, the processing in Step S101 is initiated. Then, the processing explained in FIG. 26 is repeated.

Figure 28B:
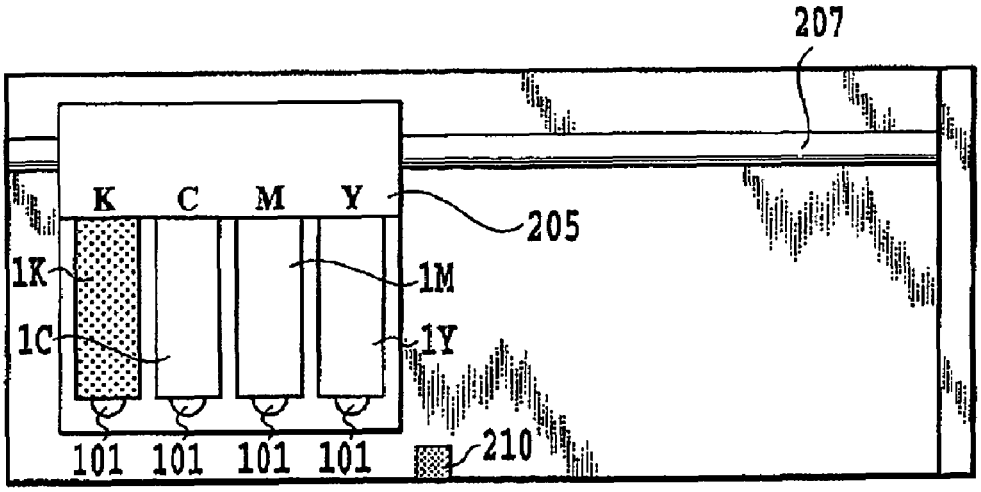

When a judgment is made that the detaching and attaching process is terminated normally in Step S102, the processing stands by in Step S103 until the body cover 201 is closed by the user. Then, a judgment is made in Step S104 as to whether the cover 201 is closed or not. Here, upon a judgment that the body cover is closed, the processing goes to an optical checking process in Step S105. In this case, upon detection of the closed body cover 201 as shown in FIG. 28B, the carriage 205 moves to a position for the optical check and turns off the lighted LEDs 101 of the respective ink tanks.

The optical checking process judges whether or not each of the ink tanks, which is normally attached, is attached to the proper position. In light of the position to attach the ink tank, this embodiment does not adopt a configuration to form the respective ink tanks and the attachment positions into different shapes so as not to allow attachment of other types of ink tanks, and to define the attachment positions in terms of the ink tanks for the respective colors. Therefore, there is a risk that the ink tank for each color may be erroneously attached to an unexpected position. For this reason, the optical checking process is performed to inform the user of the erroneous attachment. In this way, it is possible to achieve manufacturing efficiency and cost reduction of the ink tanks without intentionally changing the shapes of the ink tanks depending on the ink colors.

FIGS. 29A to 29D and FIGS. 30A to 30D are views for explaining the optical checking process.

Figure 29A:
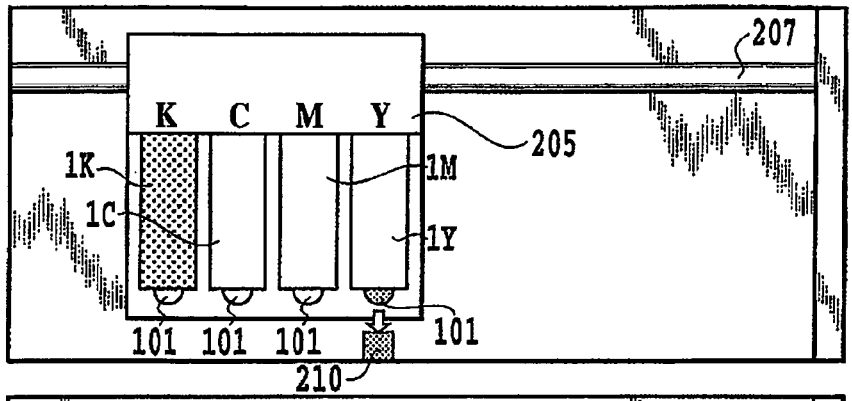
FIGS. 29A to 29D are views for explaining this optical checking process.

As shown in FIG. 29A, movement of the carriage 205 is started from the left side to the right side in the drawing relative to the light receiving portion 210. Then, a process to cause the LED 101 for the ink tank 1Y to emit the light is firstly performed at a position where the ink tank at a position to which the ink tank 1Y for the yellow ink should be attached, faces the light receiving portion 210. In reality, this process is continued from the point of turning the light on to the point of turning the light off after passage of a predetermined time period as described with reference to FIG. 24. This rule applies similarly throughout the checking process. When the ink tank is fitted in the correct position, the light receiving portion 210 can receive the light emitted from the LED 101, that is, the projecting light from the end 104B of the light guiding portion 104, whereby the control circuit 300 judges that the ink tank 1Y is properly fitted in that attachment position.

Figure 29B:
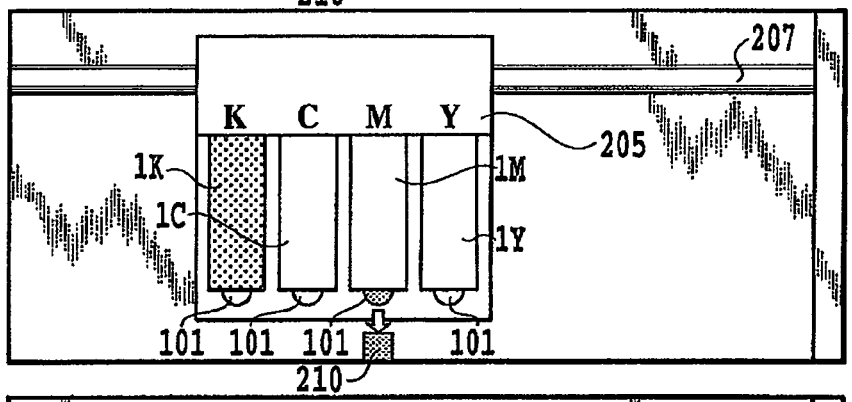
Figure 29C:
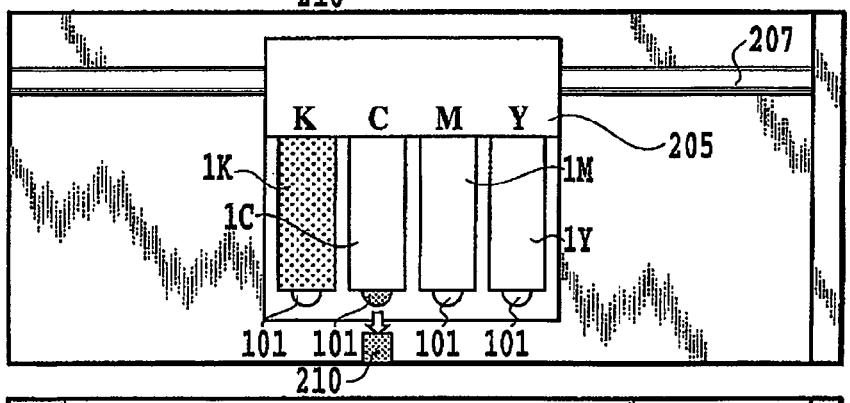
Figure 29D:
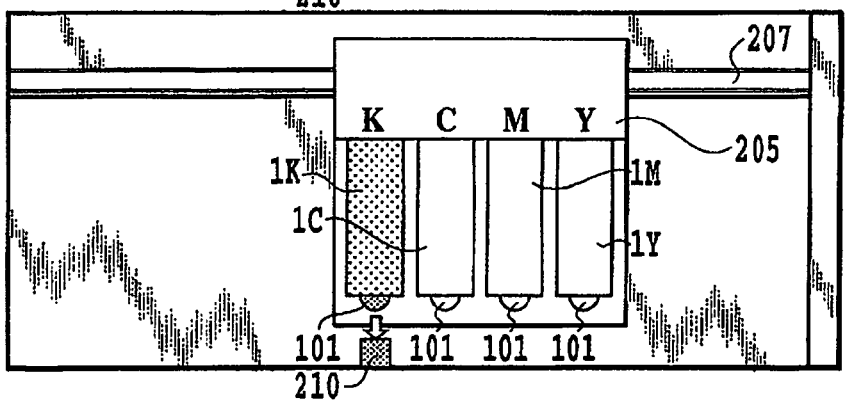

Similarly, as shown in FIG. 29B, the carriage 205 is moved and the LED 101 of the ink tank 1M is caused to emit the light at a position where the ink tank at a position to which the ink tank 1M for the magenta ink should be attached, faces the light receiving portion 210. The example illustrated in the drawing shows an aspect in which the ink tank 1M is fitted in the correct position so that the light receiving portion 210 receives the light emitted therefrom. Likewise, the light emission is executed similarly as shown in FIGS. 29B to 29D while changing the location subject to the judgment. These drawings show the example in which all the ink tanks are fitted in the correct positions.

Figure 30A:
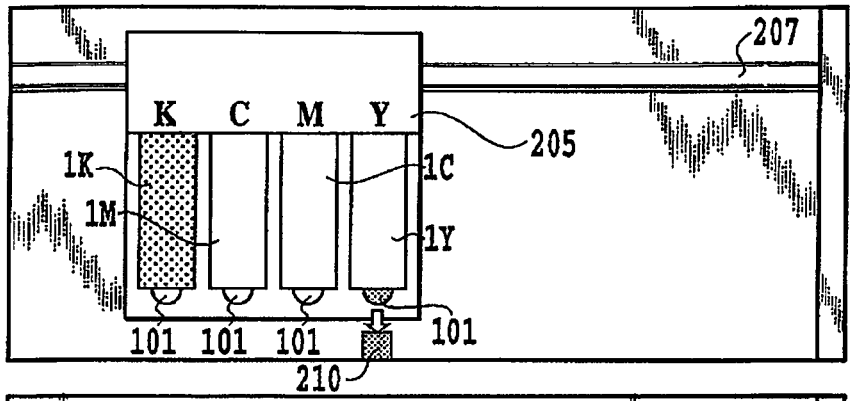
FIGS. 30A to 30D are more views for explaining the optical checking process.
Figure 30B:
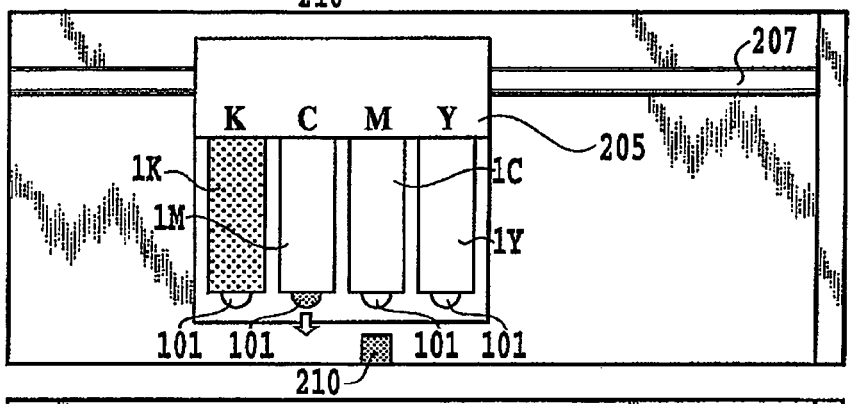
Figure 30C:
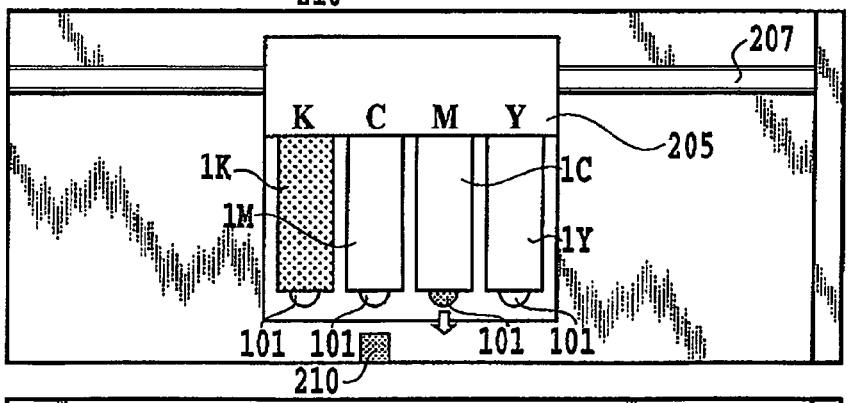
Figure 30D:
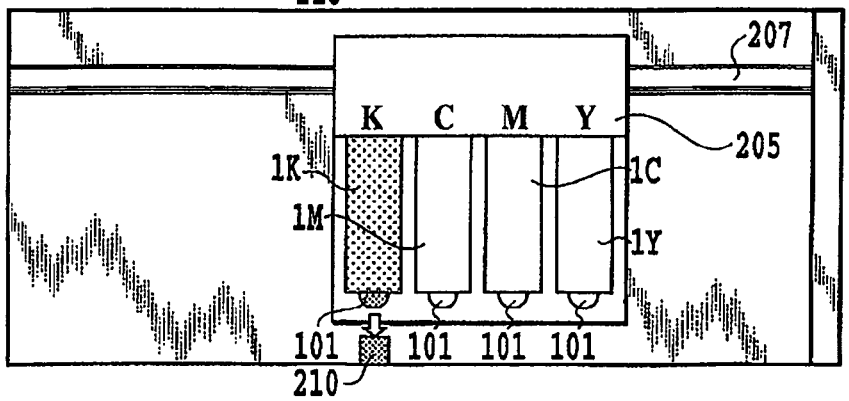

In the meantime, a case where the ink tank 1C for the cyan ink is erroneously fitted in the position supposed to attach the ink tank 1M for the magenta ink will be assumed as shown in FIG. 30B. In this case, the light is not emitted from the LED 101 of the ink tank 1C opposed to the light receiving portion 210. Instead, the light is emitted from the LED 101 of the ink tank 1M which is mounted on a different location. As a result, at this timing, the light receiving portion 210 cannot receive any light. Therefore, the control circuit 300 judges that the ink tank other than the ink tank 1M is fitted in this attachment position. On the contrary, the ink tank 1M for the magenta ink is erroneously fitted in the position supposed to attach the ink tank 1C for the cyan ink as shown in FIG. 30C. Here, the light is, not emitted from the LED 101 of the ink tank 1M opposed to the light receiving portion 210. Instead, the light is emitted from the LED 101 of the ink tank 1C which is mounted on a different location.

By executing the optical checking process as described above, the control circuit 300 can specify the ink tank which is not fitted to the expected position. Moreover, when the proper ink tank is not fitted in the expected position, it is possible to identify the color of the ink in the erroneously attached ink tank by performing control for sequentially causing the light emission from the three other ink tanks in that attachment positions.

After the optical checking process at Step S105, in FIG. 25, a judgment is made in Step S106 as to whether or not this process is completed normally. In the case of the judgment of normal completion of the optical checking process, the process is terminated in Step S107 while turning green light on the indicator of the console unit 213, for example. On the contrary, in the case of the judgment that the process is not completed normally, the indicator of the console unit 213 is caused to blink in orange light in Step S109, for example. Then, in Step S110, the LED 101 of the ink tank not fitted in the proper position, which is specified in Step S105, is subjected to blinking or is turned on, for example. In this way, in Step S108, the user can recognize the ink tank which is not fitted in the proper position when the user opens the body cover 201. Accordingly, it is possible to urge the user to fit the relevant ink tank in the proper position.

Figure 31:
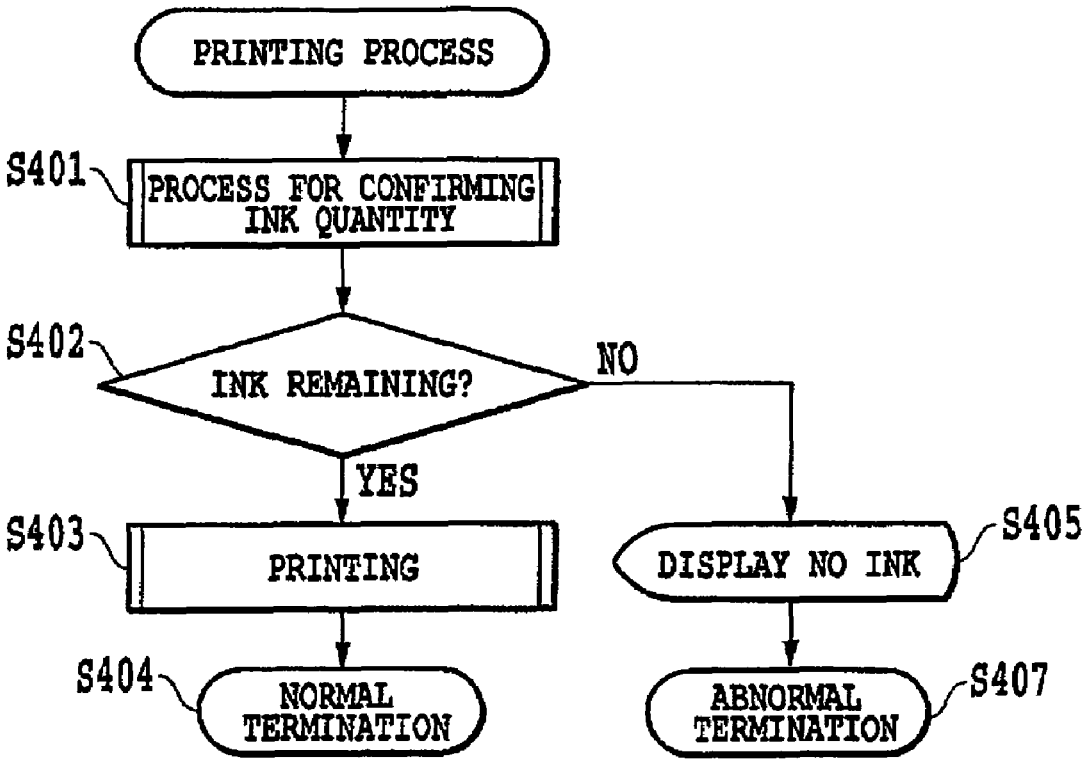
FIG. 31 is a flowchart showing a printing process in the embodiment.

FIG. 31 is a flowchart showing a printing process in this embodiment. In this process, an ink residual quantity confirmation process is firstly preformed in Step S401. This is the process of calculating a printing amount by use of printing data of a job to be printed from now, then comparing this amount with the residual quantity of each type of the ink, and then judging whether or not there is a sufficient amount of ink for printing that job. In this process, the above-described residual quantity may apply the value which is counted by the control circuit 300 as the residual quantity at that time.

In Step S402, a judgment is made as to whether or not there is the sufficient amount of ink based on the foregoing confirmation process. When there is the sufficient amount of the ink, a printing operation is executed in Step S403. Then, the indicator of the console unit 213 is lighted in green in Step S404 and the process is terminated normally. On the contrary, when the judgment is made in Step S402 that there is not the sufficient amount, the indicator of the console unit 213 is blinked in orange in Step S405 and the LED 101 of the ink tank having the small ink residual quantity is blinked or turned on in Step S406, then the process is terminated abnormally. When the host PC for controlling the printing apparatus is connected, it is also possible to display the ink residual quantity on a PC monitor at the same time.

3. Others

The embodiments describe the configuration of the ink tank holder in the form of the printing head cartridge that integrates the printing head unit. However, the ink tank holder is not limited only to this configuration. Specifically, it is possible to provide the ink tank holder independently from the printing head as long as the ink tank is rendered capable of supplying the ink to the printing head by way of ink communication upon attachment of the ink tank.

Moreover, the number of the ink tanks and the holders, the aspect of containing the ink, and the structures of the printing head unit and the ink jet printing apparatus for attaching the ink tanks are not limited only to the foregoing explanations. In addition, the color tone of the inks used therein may be monochrome or multicolor. Moreover, addition to use the ink as a coloring material, it is also possible to utilize the ink tank for containing a processing liquid for improving color fixation, color appearance or durability on a printing medium, for example.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes.

This application claims priority from Japanese Patent Application No. 2005-185746 filed Jun. 24, 2005, which is hereby incorporated by reference herein.

What is claimed is:

1. An ink tank holder for detachably retaining an ink tank in which the ink tank comprises an ink containing portion for containing ink to be used for an ink jet printing apparatus, a light emitting portion, and a contact to receive a signal for driving the light emitting portion from the ink jet printing apparatus, wherein the ink tank holder comprises:

a mount for detachably retaining the ink tank; and a light guiding portion for receiving light from the light emitting portion and guiding the light to project the light from a first light projecting section;

wherein the light guiding portion is provided at a location which is opposed to the ink tank in a state where the ink tank is retained in the mount, and wherein the light guiding portion guides the light at least partly along a perimeter of the ink tank.

2. An ink tank holder as claimed in claim 1, wherein the ink tank further comprises an operating portion for carrying out an attaching and detaching operation, and wherein the first light projecting section is an end portion of the light guiding portion disposed in a region located in the vicinity of the operating portion in a state where the ink tank is retained in the mount.

3. An ink tank holder as claimed in claim 1, wherein the ink tank further comprises an operating portion for carrying out an attaching and detaching operation, and a third light projecting section provided on the operating portion, and wherein the light guiding portion and the first light projecting section on the ink tank holder guide the light to the third light projecting section provided on the operating portion.

4. An ink tank holder as claimed in claim 1, wherein the first light projecting section is disposed in a position corresponding to at least any one of a visible position and a position capable of facing a light receiving portion of the ink jet printing apparatus.

5. An ink tank holder as claimed in claim 1, wherein the light guiding portion has a branch for guiding the light to a second light projecting section different from the first light projecting section.

6. An ink tank holder as claimed in claim 5, wherein the light guiding portion has a further branch for guiding the light to a light projecting section different from the first and second light projecting sections.

7. An ink tank holder as claimed in claim 5, wherein the ink tank further comprises a prism-shaped detection target for ink residual quantity detection configured to be capable of reflecting incident light back to a light receiving portion when the ink is not contained, and wherein the light guiding portion is configured to guide the light to the second light projecting section disposed in a position facing one of oblique surfaces of the prism-shaped detection target in a state where the ink tank is retained in the mount.

8. An ink tank holder as claimed in claim 1, wherein the ink tank holder detachably retains a plurality of ink tanks.

9. An ink tank holder as claimed in claim 3, wherein the first light projecting section is connected to a section different from a light guiding portion provided on the operating portion to guide the light to the third light projecting section provided on the operating portion.

10. An ink jet printing head cartridge comprising:

an ink tank holder as claimed in claim 1; and a printing head for ejecting ink contained in the ink containing portion of the ink tank, wherein the printing head is integrated with the ink tank holder.

11. An ink tank holder as claimed in claim 1, wherein the ink tank holder further comprises a housing portion opposed to the perimeter of the ink tank in a state where the ink tank is retained in the mount, and wherein the light guiding portion guides light within the housing portion.

* * * * *